US012680411B2

(12) United States Patent
Boyd et al.

(10) Patent No.: US 12,680,411 B2
(45) Date of Patent: Jul. 14, 2026

(54) WELLHEAD FLOW BLOCK AND FLOW CONTROL MECHANISMS

(71) Applicant: Flowco MasterCo LLC, Houston, TX (US)

(72) Inventors: Mitchell A. Boyd, Haslet, TX (US); Darrell Mitchum, Oakhurst, TX (US); Garrett S. Boyd, Granbury, TX (US)

(73) Assignee: Flowco MasterCo LLC, Houston, TX (US)

( * ) Notice: Subject to any disclaimer, the term of this patent is extended or adjusted under 35 U.S.C. 154(b) by 0 days.

(21) Appl. No.: 19/254,591

(22) Filed: Jun. 30, 2025

(65) Prior Publication Data

US 2025/0334020 A1 Oct. 30, 2025

Related U.S. Application Data

(63) Continuation-in-part of application No. 18/918,584, filed on Oct. 17, 2024, which is a continuation of application No. 18/797,839, filed on Aug. 8, 2024, now Pat. No. 12,460,500, which is a continuation of application No. 18/497,590, filed on Oct. 30, 2023, now Pat. No. 12,098,609.

(51) Int. Cl.

| | |
|---|---|
| ***E21B 33/068*** | (2006.01) |
| ***E21B 4/00*** | (2006.01) |
| ***E21B 7/12*** | (2006.01) |
| ***E21B 23/12*** | (2006.01) |

(52) U.S. Cl.
CPC ..... *E21B 33/068* (2013.01)

(58) Field of Classification Search
CPC ..... E21B 33/068; E21B 4/00; E21B 23/12; E21B 43/12; E21B 7/12; E21B 23/02
USPC ..... 166/90.1
See application file for complete search history.

(56) References Cited

U.S. PATENT DOCUMENTS

| | | | | |
|---|---|---|---|---|
| 3,085,819 A | | 4/1963 | Kassmeier | |
| 3,095,819 A | | 7/1963 | Brown | |
| 3,095,891 A | * | 7/1963 | Clements | F15C 4/00 91/47 |
| 3,351,021 A | | 11/1967 | Moore, Jr. | |

(Continued)

OTHER PUBLICATIONS

Office Action (Notice of Allowance and Fees Due (PTOL-85)) dated Aug. 29, 2025 for U.S. Appl. No. 18/918,532 (pp. 1-8).

(Continued)

*Primary Examiner* — Nicole Coy
*Assistant Examiner* — Douglas S Wood
(74) *Attorney, Agent, or Firm* — Jason P. Mueller; FisherBroyles, LLP

(57) ABSTRACT

A unitary wellhead flow block lubricator assembly includes a unitary body and flow passageways that extend through the unitary body. Various openings on the exterior of the unitary body allow flow control devices to be mounted in the flow passageways to control the flow of fluid though the flow passageways. One or more of the control devices could be mountable in two or more orientations that alter the way in which the flow control device controls flow through one or more passageways in the unitary body. One or more choke mechanisms may also be mounted on the unitary body. The choke mechanisms may allow an operator to selectively adjust a flow of fluid through one or more of the passageways in the unitary body.

20 Claims, 30 Drawing Sheets

(56) References Cited

U.S. PATENT DOCUMENTS

| | | | | |
|---|---|---|---|---|
| 4,613,140 | A | 9/1986 | Knox | |
| 5,832,956 | A | 11/1998 | Nimberger | |
| 5,957,200 | A | 9/1999 | Majek | |
| 7,331,393 | B1 | 2/2008 | Hoel | |
| 9,587,444 | B2 | 3/2017 | Agarwal | |
| 9,850,731 | B2 | 12/2017 | Maerz | |
| 11,761,286 | B2 | 9/2023 | Robinson | |
| 11,828,129 | B1 * | 11/2023 | Rogers | E21B 34/02 |
| 12,065,903 | B1 | 8/2024 | Boyd | |
| 12,098,609 | B1 | 9/2024 | Boyd | |
| 12,221,805 | B2 * | 2/2025 | Zook | E05B 17/0041 |
| 2006/0108126 | A1 | 5/2006 | Horn | |
| 2010/0294507 | A1 | 11/2010 | Tanton | |
| 2014/0020909 | A1 | 1/2014 | Mckeon | |
| 2014/0151063 | A1 * | 6/2014 | Wright | H10D 86/60 166/97.1 |
| 2015/0316169 | A1 | 11/2015 | Bohaychuk | |
| 2016/0123109 | A1 | 5/2016 | Hoang | |
| 2016/0223089 | A1 | 8/2016 | Nijland | |
| 2016/0265288 | A1 | 9/2016 | Kenworthy | |
| 2016/0341195 | A1 | 11/2016 | Roycroft | |
| 2017/0044882 | A1 | 2/2017 | Casey | |
| 2017/0122084 | A1 * | 5/2017 | Brewer | E21B 43/121 |
| 2017/0342792 | A1 | 11/2017 | Mchugh | |
| 2019/0234191 | A1 * | 8/2019 | Murdoch | E21B 43/12 |
| 2019/0324191 | A1 | 10/2019 | Crompvoets | |
| 2021/0054839 | A1 | 2/2021 | Kegin | |
| 2021/0071505 | A1 | 3/2021 | Boyd | |
| 2022/0018206 | A1 | 1/2022 | Perschke | |
| 2022/0290499 | A1 | 9/2022 | Geldenhuys | |
| 2022/0349280 | A1 * | 11/2022 | Brewer | F04B 47/12 |
| 2023/0175350 | A1 | 6/2023 | Freeman | |
| 2023/0185350 | A1 | 6/2023 | Koerner | |
| 2023/0287769 | A1 * | 9/2023 | Roycroft | E21B 43/129 |
| 2023/0387769 | A1 | 11/2023 | Myung | |
| 2024/0052728 | A1 | 2/2024 | Zahran | |
| 2024/0102351 | A1 | 3/2024 | Freeman | |

OTHER PUBLICATIONS

Office Action (Notice of Allowance and Fees Due (PTOL-85)) dated Jul. 17, 2025 for U.S. Appl. No. 18/797,839 (pp. 1-8).

Office Action (Final Rejection) dated Aug. 20, 2025 for U.S. Appl. No. 18/918,584 (pp. 1-9).

International Search Report and Written Opinion issued in App. No. PCT/US2024/046699, dated Nov. 14, 2024, 8 pages.

Office Action (Non-Final Rejection) dated Jun. 17, 2025 for U.S. Appl. No. 18/918,532 (pp. 1-12).

Office Action (Non-Final Rejection) dated Jun. 23, 2025 for U.S. Appl. No. 18/918,584 (pp. 1-12).

* cited by examiner

WELLHEAD FLOW BLOCK AND FLOW CONTROL MECHANISMS

This application is a continuation-in-part of U.S. application Ser. No. 18/918,584, filed Oct. 17, 2024, which is itself a continuation of U.S. application Ser. No. 18/797,839, filed Aug. 8, 2024, which is itself a continuation of U.S. application Ser. No. 18/497,590, filed Oct. 30, 2023, the contents of all of which are incorporated herein by reference.

BACKGROUND OF THE INVENTION

The present disclosure relates to an integrated wellhead flow block lubricator assembly that is configured to function as both a flow block or manifold for natural flowing wells as well as a flow block lubricator assembly for wells using a plunger to enhance production. The integrated wellhead flow block lubricator assembly would be mounted on an outflow pipe of a well.

When a plunger is used in a well to enhance production, the natural gas energy propelling the plunger to the surface and the appropriate differential pressure across the plunger is essential for successful plunger cycles to lift liquids to the surface. A plunger catcher mechanism is often integrated in the body of the lubricator. The plunger catcher mechanism is configured to hold and release a plunger.

A plunger lift lubricator can be assembled with various internal configurations depending on the type of plunger utilized in the tubing string. Traditional lubricators have two outlets, an upper outlet and a lower outlet. Control over the flow of gas and fluids through the lubricator makes it possible to control the landing position of the plunger in the lubricator. The lower outlet typically has a ball valve or choke mechanism to allow the operator to adjust or restrict the flow of liquid out of the lower outlet, thereby forcing more flow to the upper outlet. This creates less restriction or less back pressure at the upper outlet, which forces the plunger to travel upward towards the upper outlet. The plunger can then be captured in the lubricator and released at intervals controlled by a surface controller. The surface controller can be programmed by the user based on the flow of gas or liquid to optimize well performance.

The plunger catcher mechanism may include a mechanism that is designed to reset a flow valve or a ball valve within the plunger such that the plunger can descend back into the wellbore. In such cases, failure to drive the plunger fully into the plunger catcher mechanism may result in the flow valve or ball valve not being reset, which would likely prevent the plunger from descending back into the wellbore.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION OF THE INVENTION

The present application discloses various devices used in connection with wells that produce fluids and gases, such as oil and natural gas. For the sake of simplicity and brevity, the following description will refer to flows of "fluid" However, references to a flow of "fluid" are intended to encompass and include flows of fluids, gases and mixtures of fluids and gases.

The following description refers to "flow restrictors" and to "flow control inserts". Both of these terms, which may be used interchangeably, refer to devices which are affixed over openings on the exterior of a wellhead flow bock lubricator and which include elements that extend into flow passageways that extend through the interior of the flow block lubricator. The flow restrictors and/or flow control inserts includes elements that are configured to selectively restrict the flow of gases and fluids through the interior passageways of the flow block lubricator.

The present disclosure is concerned with a wellhead flow block lubricator assembly that is used to control the outflow of fluid from a well. The wellhead flow block lubricator can be integrated with a plunger catcher mechanism that is configured to hold and release a plunger used in oil and gas wells.

Figure 1A:
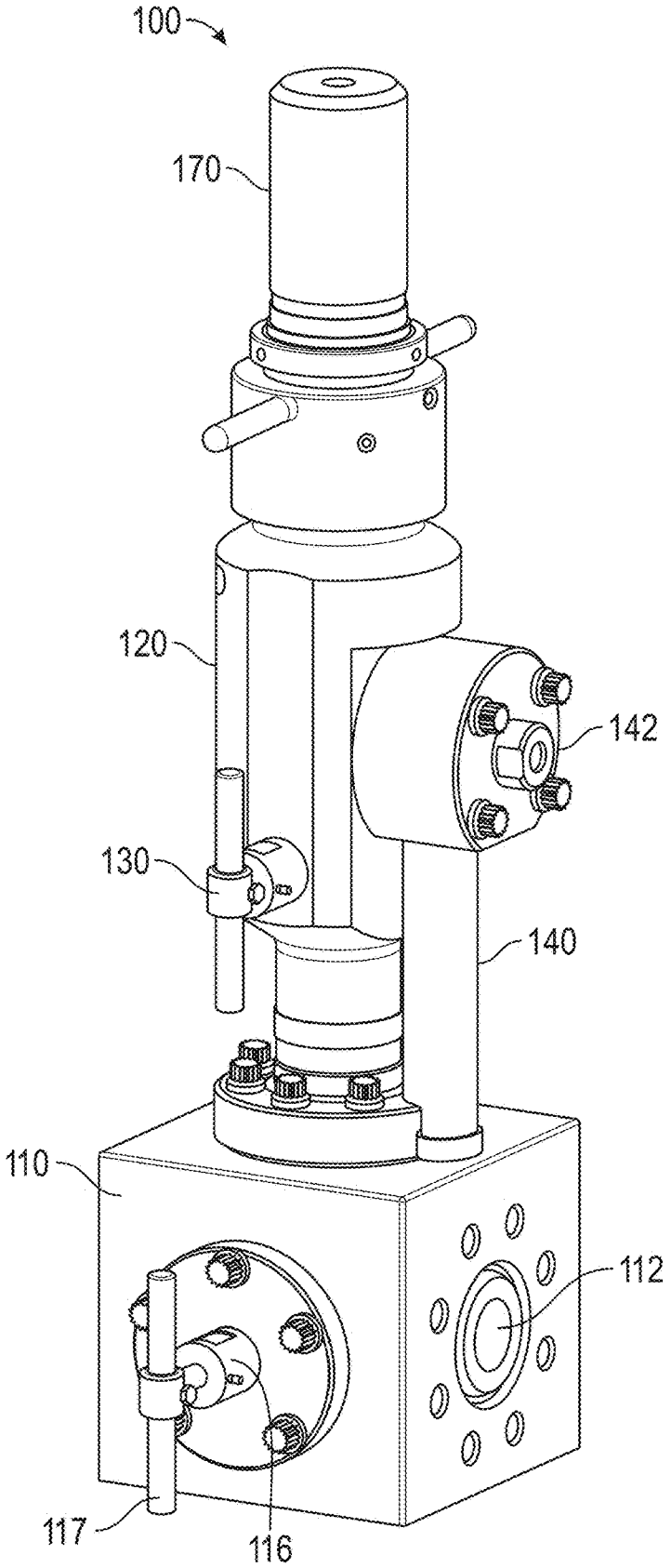
FIG. 1A is a perspective view of a first embodiment of a flow block and lubricator assembly with a plunger catcher assembly, a manually operated choke mechanism and a single return flow passageway.
Figure 1B:
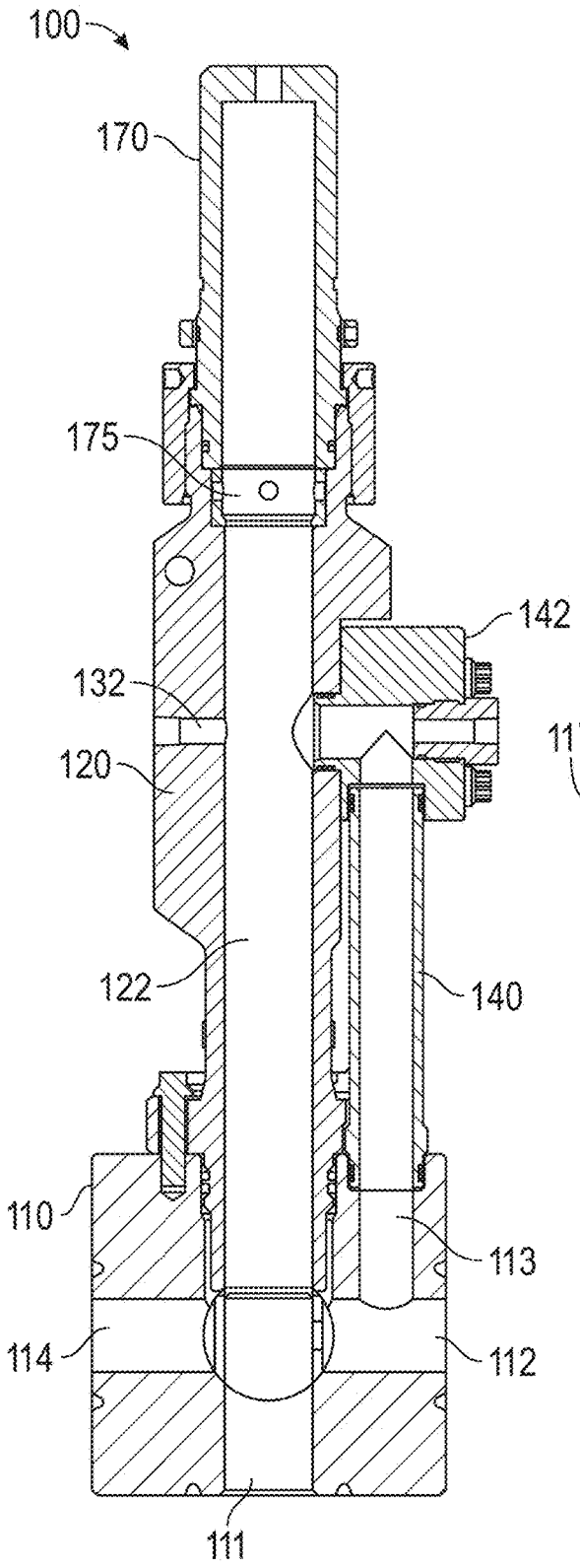
FIG. 1B is a longitudinal cross-sectional view of the flow block and lubricator assembly illustrated in FIG. 1A.
Figure 1C:
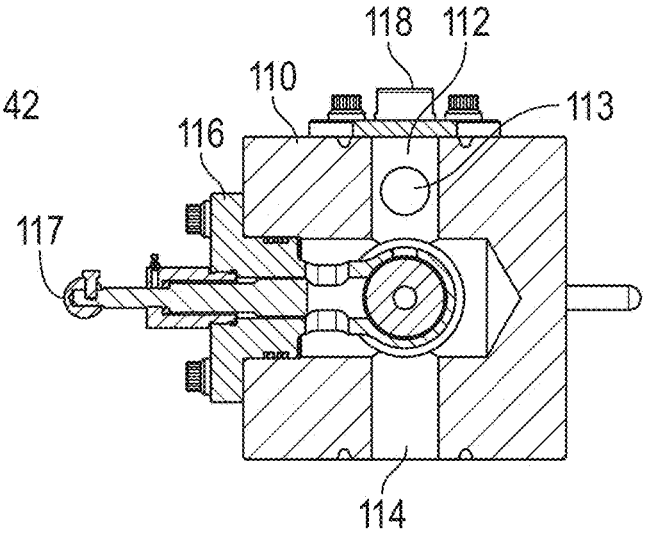
FIG. 1C is a cross-sectional view of the flow block illustrated in FIG. 1A taken through a portion of the flow block that houses the choke mechanism.

A first embodiment of a wellhead flow block and lubricator assembly is illustrated in FIGS. 1A-1C. As shown therein, a flow block 110 is mounted to the master valve and outflow pipe of a well, and an upper subassembly 120 is then mounted on top of the flow block 110. Oil or gas produced by the well is routed through the flow block 110 to a production line that typically leads to a production separator. The liquids are then collected in production tanks.

When the downhole pressure of an oil or gas well is no longer high enough to generate a sufficiently high natural flow rate, one can employ a plunger to help bring the liquids and gases to the surface. A plunger is a device that is configured to freely descend and ascend within a well bore. Some embodiments are configured as a "bypass" plunger, which may include a self-contained valve—also called a "dart" or a "dart valve"—to control the descent and ascent. Typically the valve in a bypass plunger is opened to permit fluids and gas in the well to flow through the valve and one or more internal passageways in the plunger body as the plunger descends through the well.

Upon reaching the bottom of the well, the valve or dart is closed, sealing off the internal passageway(s) within the plunger. The exterior of the plunger seals against the wall of the wellbore. With the valve or dart closed, pressure builds below the plunger until the pressure is sufficient to lift the plunger and the column of fluid in the wellbore above the plunger to the surface. As fluid above the bypass plunger arrives at the surface, the fluid is routed by the flow block 110 to a production line. While the above description applies to bypass plungers, other types of plungers can also be used to help restore production to an oil or gas well.

When a plunger arrives at the surface, it passes through the flow block 110 and into the upper subassembly 120 mounted on top of the flow block 110. A plunger catcher or holding mechanism 130 in the upper subassembly 120 can hold the plunger once the plunger arrives at a receiving location. The plunger catcher or holding mechanism 130 can also be operated to release the plunger so that it can descend back to the bottom of the wellbore.

As illustrated in FIGS. 1B, the inlet passageway 111 of the flow block 110 would be attached to the outflow pipe of the well. The inlet passageway 111 is aligned with a main passageway 122 of the upper subassembly 120. While a plunger is ascending the wellbore, pushing a column of fluid upward, the fluid can be routed out of a first outflow passageway 112 and/or a second outflow passageway 114 of the flow block 110. However, fluid exiting the well can also travel up through the main passageway 122 in the upper subassembly 120. Fluid and gas passing up the main passageway 122 is routed into a return manifold 142 and then into a return passageway 140. The fluid in the return passageway 140 is delivered into a return inlet 113 on the top of the flow block 110, which delivers the fluid back into the first and/or second outflow passageways 112/114.

The routing of fluid into the main passageway 122 of the upper subassembly 120 and then through the return manifold 142 and return passageway 140 ensures that a flow of fluid/gas will carry the plunger fully up into the upper subassembly 120 when it arrives at the surface.

If the flow of fluid out of the well is not strong, it may be necessary to partially choke off the flow of fluid moving from the inlet passageway 111 directly into the first and/or second outflow passageways 112, 114. In many instances, only one outflow passageway is connected to a production line. In other instances, both the first and second outflow passageways 112, 114 are connected to a production line. In any event, it may be necessary to choke off the flow of fluid through one or both of the outflow passageways 112, 114 so that a greater amount of fluid flows up into the unrestricted main passageway 122, upper flow manifold 142 and return passageway 140. This ensures that when the plunger arrives at the surface, the flow of fluid into the main passageway 122 of the upper subassembly 120 is strong enough to carry the plunger fully up into the receiving position in the upper subassembly 120.

FIGS. 1A-1C illustrate a choke mechanism 116/117 that can be used for this purpose. While the choke mechanism 116/117 will reduce the amount of fluid passing directly from the inlet passageway 111 into the first and/or second outflow passageways 112/114, the return passageway 140 ensures that the flow of fluid into the main passageway 122 of the upper subassembly 120 flows easily and freely out of the flow block 110.

Figure 2A:
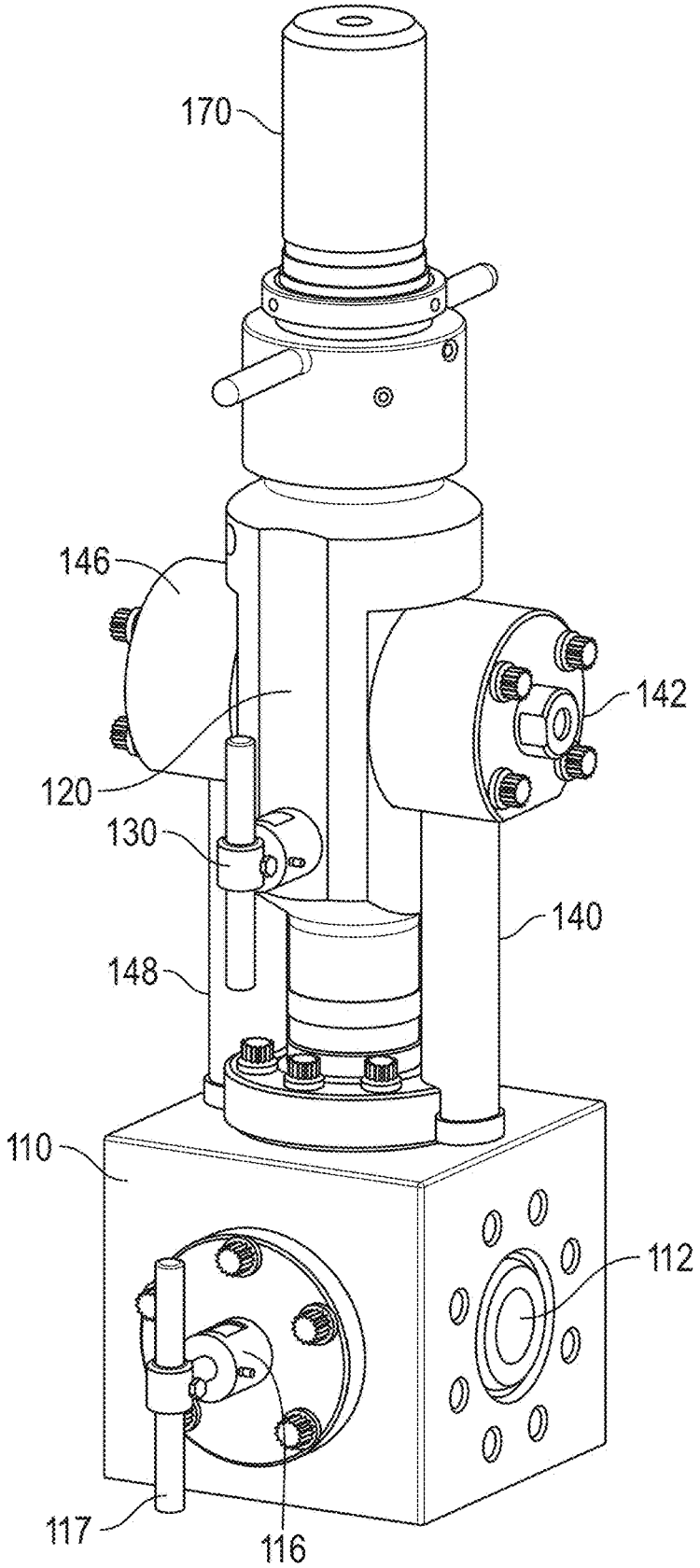
FIG. 2A is a perspective view of a second embodiment of a flow block and lubricator assembly with a plunger catcher assembly, a manually operated choke mechanism and two return flow passageways.
Figure 2B:
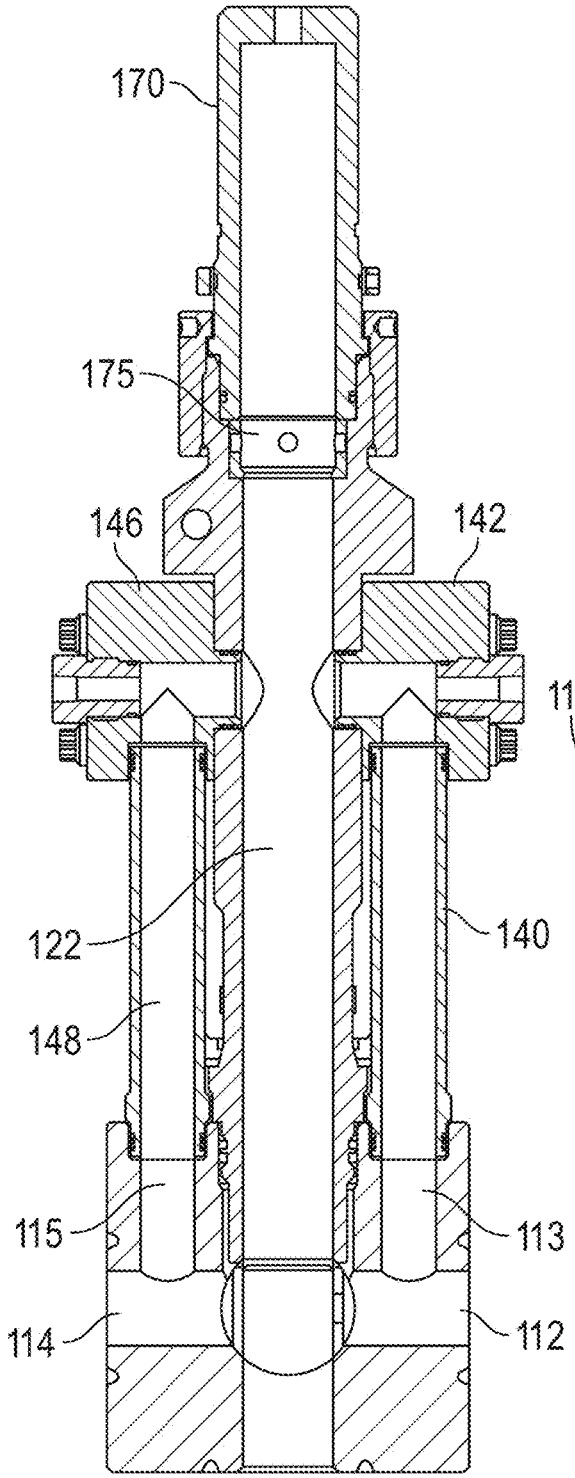
FIG. 2B is a longitudinal cross-sectional view of the flow block and lubricator assembly illustrated in FIG. 2A.
Figure 2C:
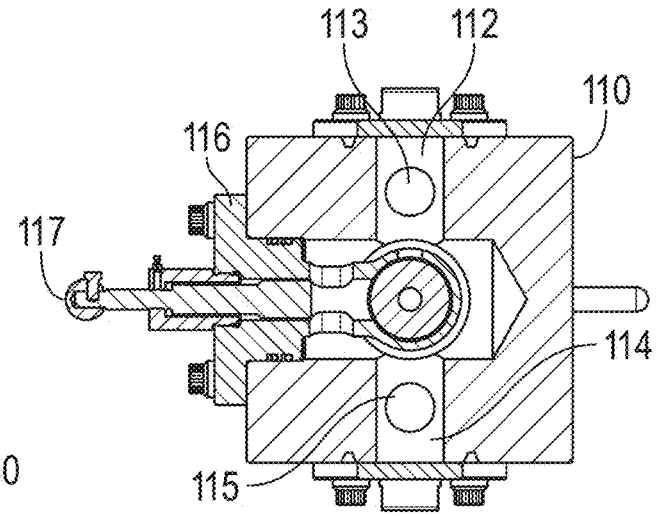
FIG. 2C is a cross-sectional view of the flow block illustrated in FIG. 2A taken through a portion of the flow block that houses the choke mechanism.

On wells that do not have a high flow rate, the embodiment illustrated in FIGS. 1A-1C having only a single return passageway 140 may be sufficient to handle the flow of fluid and gas produced by the well. However, if a well has a high flow rate, an embodiment as illustrated in FIGS. 2A-2C having first and second return passageways 140, 148 may be more appropriate. The addition of the second return passageway 148 helps to handle the flow in high flow rate wells.

When the flow rate of fluid out of the well is quite light, it may be desirable to choke the outflow of fluid through one or both of the return lines 140, 148 to cause more backpressure in the main passageway 122. The greater backpressure in the main passageway would serve to ensure that the plunger impact is controlled, thus protecting the plunger from premature failure, and also to ensure the plunger fully ascends up the main passageway 122 into the receiving position within the upper subassembly 120. As will be explained in greater detail below, one or more flow restrictors could be mounted in the return manifolds 142, 146 to restrict the flow of fluid into the first and second return passageways 140, 148.

FIGS. 3A-3D and 4A-4E illustrate two embodiments of a unitary wellhead flow block lubricator assembly that includes an integrated plunger catcher. These designs make very efficient use of the space located directly over the wellhead. In these embodiments, the main passageway and the return passageways are internal passageways that pass though the interior of a unitary body. In addition to first and second return passageways, as provided in the embodiment illustrated in FIGS. 2A-2C, embodiments as illustrated in FIGS. 3A-4E can include a third return passageway, which also would be an internal passageway. The unitary body of these designs is configured such that flow restrictors can be mounted to the unitary body to selectively control the flow of fluids through the internal passageways.

Both embodiments of the unitary wellhead flow block lubricator assembly include a unitary body 200/300 having a front 201, a first side 202, a rear 203 and a second side 204. As depicted in FIGS. 3C, 3D, 4C and 4D, an inlet passageway 222 opens to the bottom of the unitary body 200/300. The inlet passageway 222 would be connected to a master valve above the wellhead.

An integrated choke mechanism 500, which is described in more detail below, is mounted in a choke passageway 216. The choke passageway 216 leads to a first opening on the front 201 of the unitary body 200/300. A flange 502 of the integrated choke mechanism 500 is mounted over the first opening.

The inlet passageway 222 also leads to a lower distribution block that includes a first outflow passageway 212, a second outflow passageway 214 and a rear outflow passageway 218. The first outflow passageway 212 leads to a second opening on the lower portion of the first side 202 of the unitary body 200/300. The second outflow passageway 214 leads to a third opening on the lower portion of the second side 204 of the unitary body 200/300. Further, the rear outflow passageway 218 leads to a fourth opening on the rear 203 of the unitary body 200/300.

A main passageway 220, which is aligned with the inlet passageway 222, extends up the center of the unitary body 200/300. A plunger catcher mechanism 230 is mounted on the front 201 of the unitary body 200/300. When a plunger travels up to the surface of the well, the flow of fluid exiting the well causes the plunger to travel through the inlet passageway 222 and into the main passageway 220. The plunger catcher mechanism 230 includes an element that bears against the exterior of the plunger to hold it at a receiving location within the main passageway 220. A handle 231 of the plunger catcher mechanism 230 can be operated to release the plunger so that the plunger can descend back into the wellbore.

A first return passageway 242 extends through the unitary body 200/300 adjacent to the first side 202 of the unitary body 200/300 from the upper portion of the unitary body 200/300 to the lower portion of the unitary body 200/300. The lower portion of the first return passageway 242 opens into the first outflow passageway 212.

A second return passageway 244 extends through the unitary body 200/300 adjacent to the second side 204 of the unitary body 200/300 from the upper portion of the unitary body 200/300 to the lower portion of the unitary body 200/300. The lower portion of the second return passageway 242 opens into the second outflow passageway 214.

An upper distribution block is provided at the upper portion of the unitary body 200/300. The upper distribution block includes a first upper passageway 232 that extends from the main passageway 220 to a first upper opening provided on the upper portion of the first side 202 of the unitary body 200/300. An upper portion of the first return passageway 242 opens into the first upper passageway 232. The upper distribution block also includes a second upper passageway 234 that extends from the main passageway 220 to a second upper opening provided on the upper portion of the second side 204 of the unitary body 200/300. An upper portion of the second return passageway 244 opens into the first upper passageway 232.

Figure 3B:
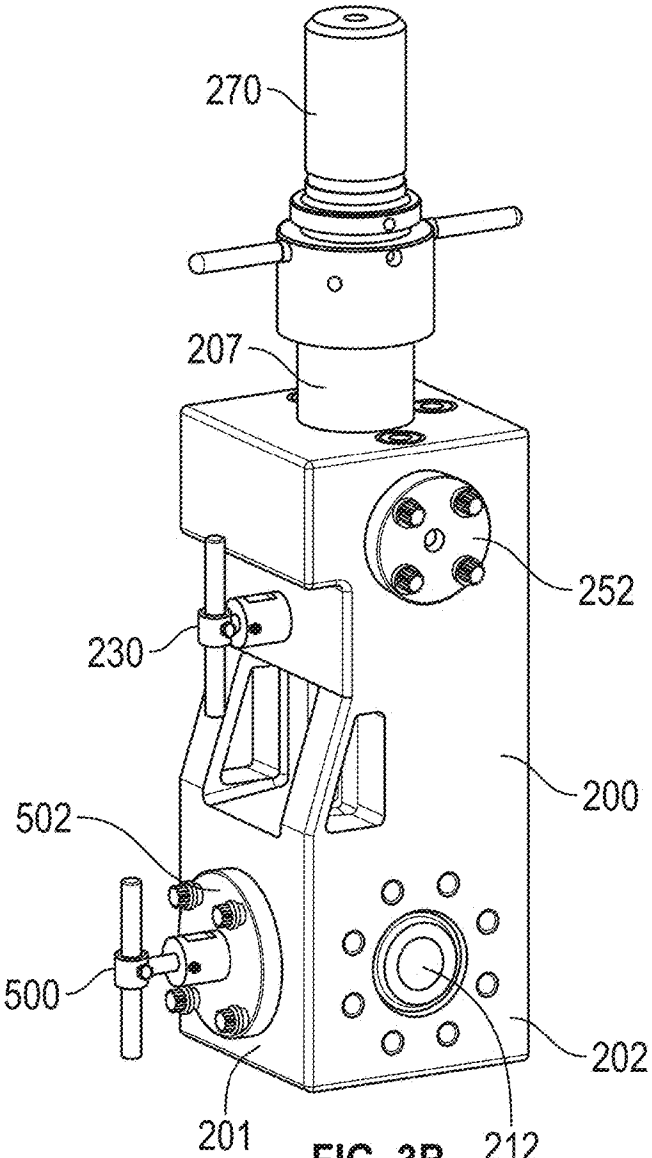
FIGS. 3A and 3B are perspective views of a first embodiment of unitary wellhead flow block lubricator assembly having internal return flow passageways.
Figure 3A:
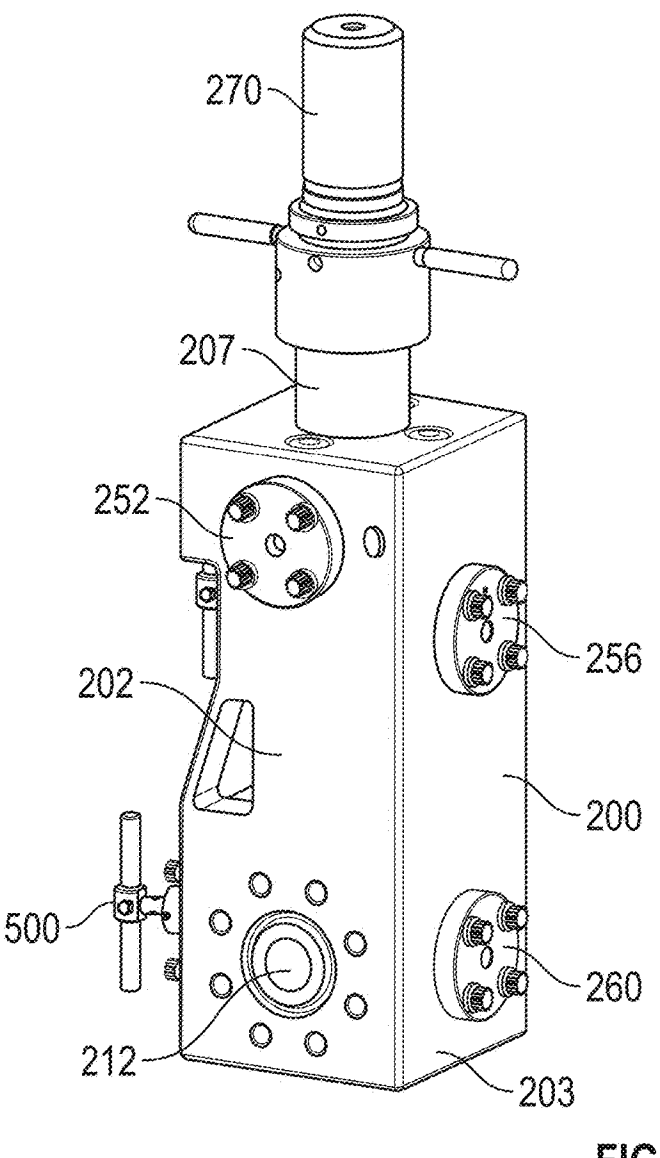
Figure 3D:
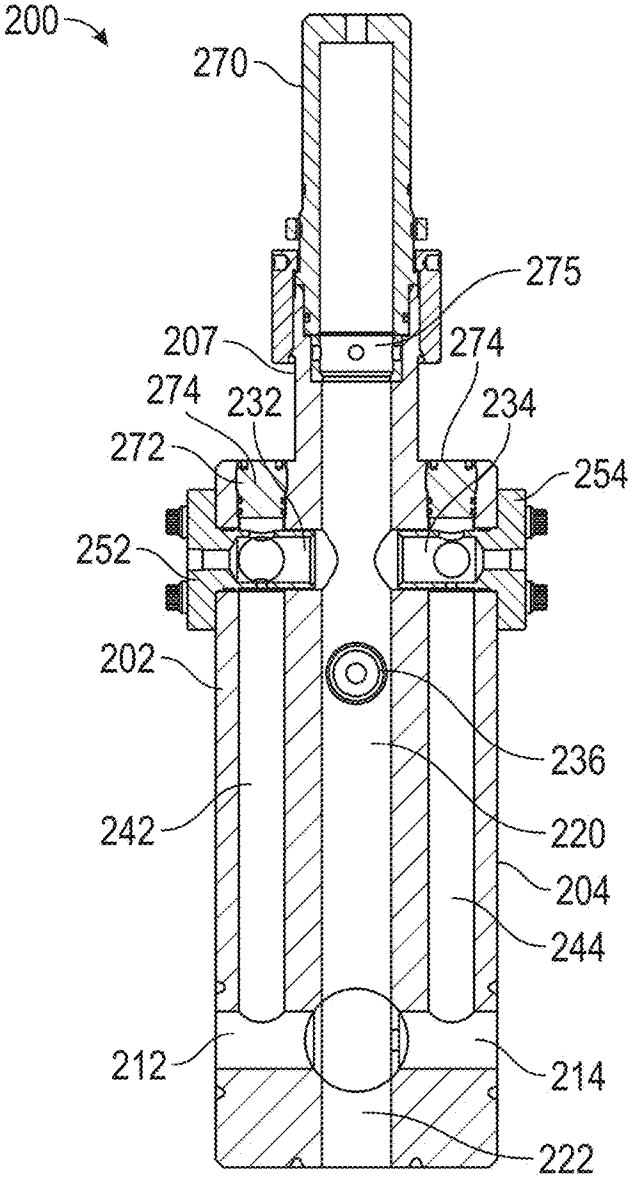
FIG. 3D is a second longitudinal cross-sectional view of the unitary wellhead flow block lubricator assembly illustrated in FIGS. 3A and 3B.
Figure 3C:
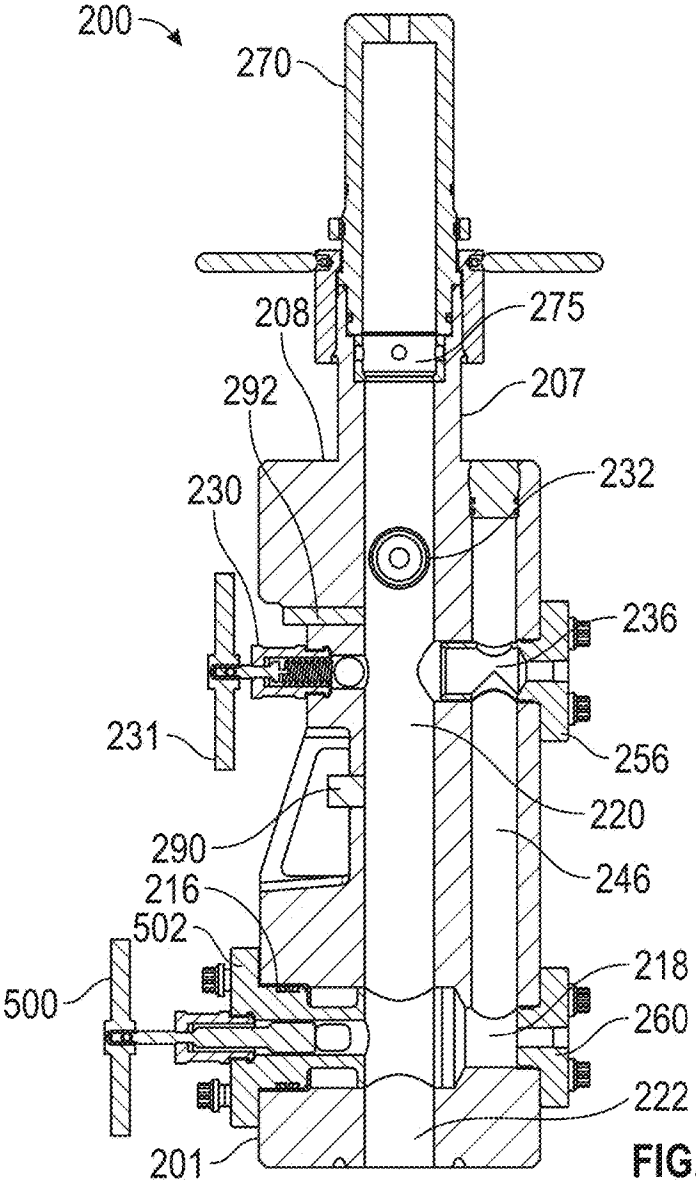
FIG. 3C is a first longitudinal cross-section view of the unitary wellhead flow block lubricator assembly illustrated in FIGS. 3A and 3B.
Figure 4B:
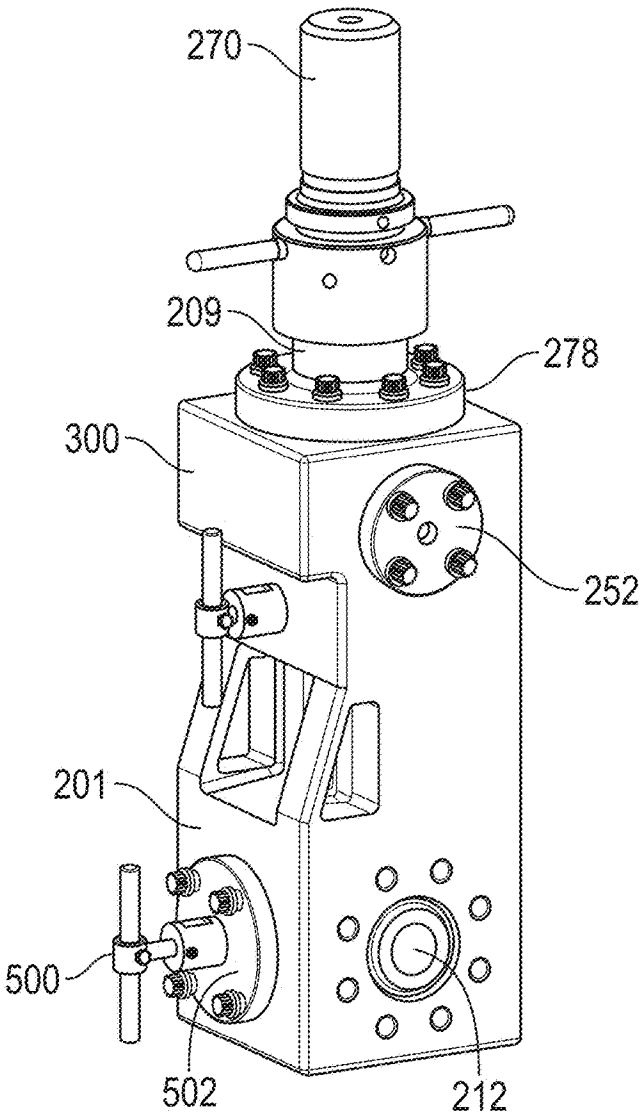
FIGS. 4A and 4B are perspective views of a second embodiment of unitary wellhead flow block lubricator assembly having internal return flow passageways.
Figure 4A:
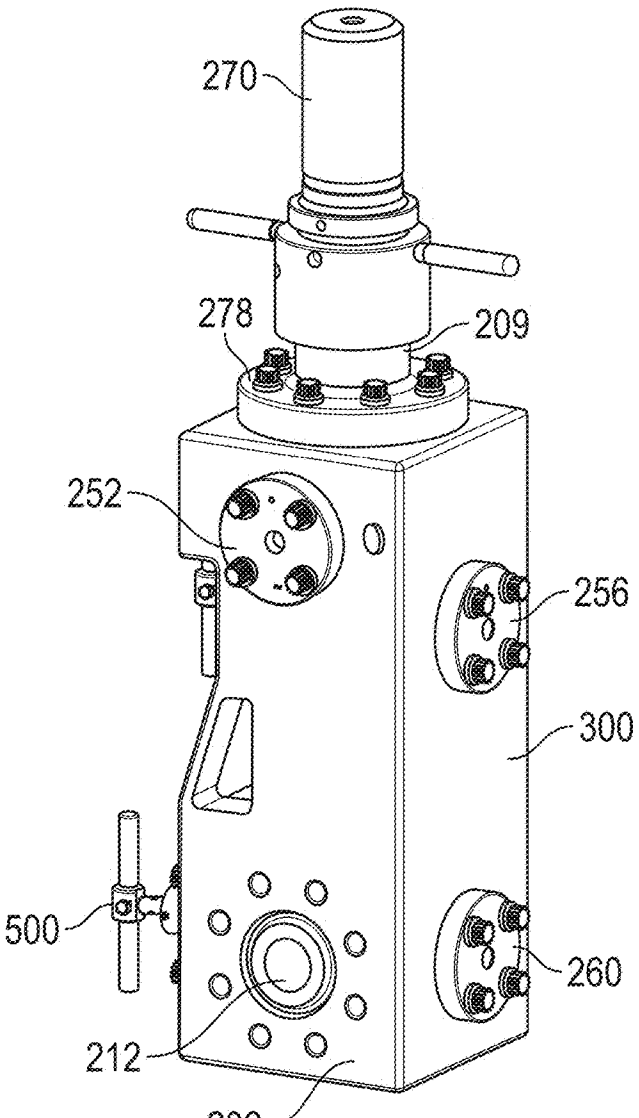
Figure 4D:
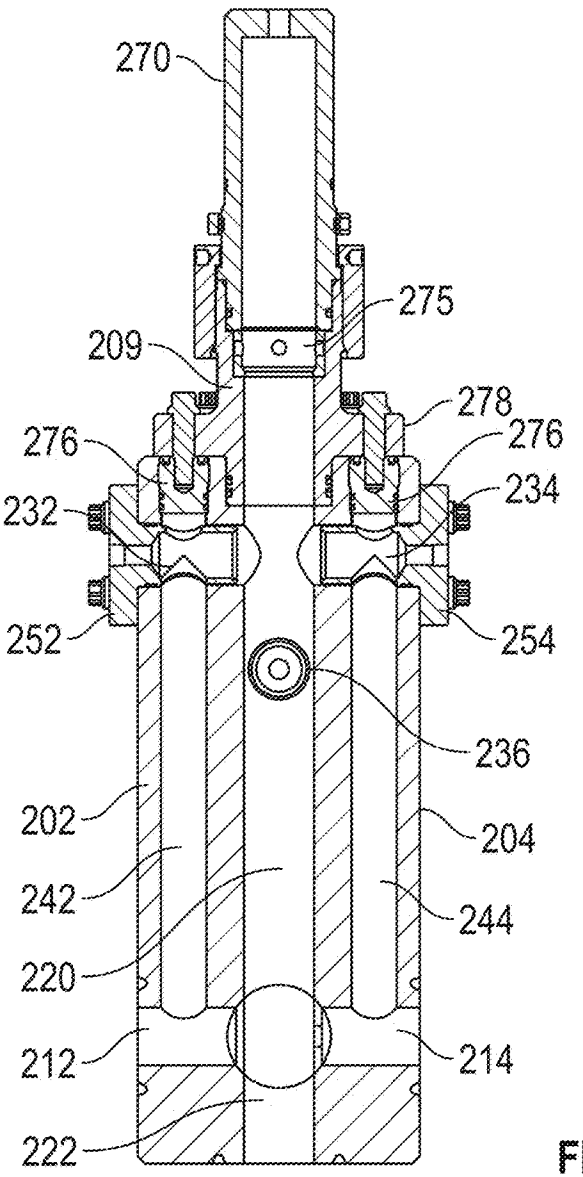
FIG. 4D is a second longitudinal cross-sectional view of the unitary wellhead flow block lubricator assembly illustrated in FIGS. 4A and 4B.
Figure 4C:
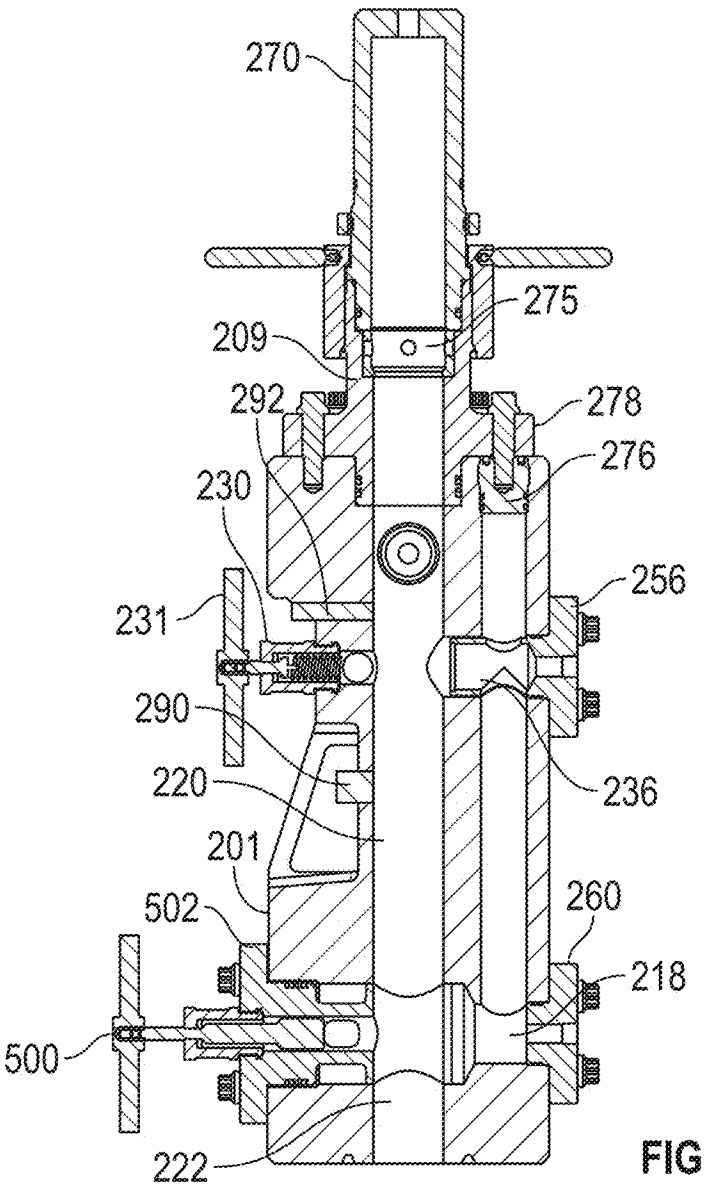
FIG. 4C is a first longitudinal cross-section view of the unitary wellhead flow block lubricator assembly illustrated in FIGS. 4A and 4B.

As depicted in FIGS. 3C and 4C, a third return passageway 246 extends through the unitary body adjacent the rear 203 of the unitary body 200/300 from a position partway up the unitary body to a position that opens into the rear outflow passageway 218. A third upper passageway 236 extends from the main passageway 220 to a third upper opening provided at a midpoint of the rear 203 of the unitary body 200/300. An upper portion of the third return passageway 246 opens into the third upper passageway 236. Note, the location of the third upper passageway 236 is lower than the position of the first upper passageway 232 and the second upper passageway 234. This can be significant when setting the flow of fluids through the internal passageways of the unitary body 200/300.

The third return passageway 246 provides additional flow output from the main passageway 220 back into the first and second outflow passageways 212/214. The provision of the third upper passageway 236 and the third return passageway 246 can be used to dampen the impact that can occur when the plunger surfaces by allowing the fluid/gas to exit the main passageway 220 from a location that is lower in the unitary body 200/300 than where fluid/gas exits the main passageway 220 via the first and second upper passageways 232/234.

FIGS. 3C and 4C also illustrate that a plunger arrival sensor 290 may be mounted on the front 201 of the unitary body 200/300 at a position below the plunger catcher assembly 230. The plunger arrival sensor 290 is mounted in a sensor hole or sensor passageway that extends from the front 201 of the unitary body 200/300 into the main passageway 220. The plunger arrival sensor 290 detects when a plunger arrives within the unitary body 200/300. In some embodiments, the plunger arrival sensor 290 could be connected to a control system that controls, among other things, when the plunger is released back down into the wellbore.

FIGS. 3C and 4C also illustrate that a plunger seated sensor 292 may be mounted on the front 201 of the unitary body 200/300 at a position above the plunger catcher assembly 230. The plunger seated sensor 292 is configured to detect when a plunger has traveled all the way into the proper receiving position within the unitary body 200/300.

As is well known to those of skill in the art, it may be necessary for the plunger to travel all the way up into a receiving position within the lubricator so that an element within the lubricator can reset a valve arrangement in or on the plunger that allows the plunger to descend back into the wellbore. If the plunger does not arrive at the proper receiving position, the valve arrangement may not be reset and it may be impossible for the plunger to descend back into the wellbore. For these reasons, in some embodiments, the plunger seated sensor 292 could be connected to a control system that controls, among other things, when the plunger is released back down into the wellbore.

The plunger arrival sensor 290 and the plunger seated sensor 292 could make use of a variety of different sensing technologies to detect when a plunger arrives within the main passageway 220 of the unitary body 200/300 and whether or when the plunger is fully seated at the receiving position within the lubricator. The sensing technologies could include magnetic or metallic sensors, various optical sensors, as well as mechanical sensors or switches. In some embodiments, the plunger arrival sensor 290 and the plunger seated sensor 292 could utilize the same type of sensing technology and even be the same type of sensor. In other embodiments, the plunger arrival sensor 290 may use a first type of sensing technology and the plunger seated sensor 292 may use a second, different type of sensing technology.

Although FIGS. 3C and 4C illustrate the plunger arrival sensor 290 and the plunger seated sensor 292 mounted in sensor holes that extends into the main passageway 220, in alternate embodiments it may not be necessary for the sensor holes for one or both of the sensors to extend all the way into the main passageway 220. For example, if the plunger arrival sensor 290 and/or the plunger seated sensor 292 make use of a magnetic or metallic sensor, it may be sufficient for the detecting end of the sensor to simply be located closely adjacent to the main passageway 220 in order to sense the plunger. In that case, the sensor hole in which the sensor is mounted may not extend all the way into the main passageway 220.

As is well known to those of skill in the art, the lubricator cap assembly 270 may house one or more mechanisms that facilitate handling the plunger. These mechanisms can include an anvil that the plunger hits when it arrives in the receiving location. The anvil can be mounted to a spring assembly that is designed to cushion any mechanical shock or jarring that can occur if the plunger travels rapidly up the main passageway 220 of the unitary body 200/300 and impacts the anvil.

There may also be a reset bar or rod that extends down from the lubricator cap assembly 270 into an upper portion of the main passageway 220. The lower end of reset bar or rod would be located at a position within the main passageway 220 that will be occupied by the plunger when it is seated at the receiving position. When such a reset bar or rod is provided, upward movement of the plunger will cause the reset bar or rod to extend down into an interior of the plunger. The upward movement of the plunger relative to the stationary reset bar or rod will cause the reset bar or rod to reset a valve mechanism within the plunger into an open condition. Opening that valve mechanism would allow fluid to pass through an internal passageway of the plunger, which allows the plunger to descend back into the wellbore. Key to successful operation of the plunger is that the plunger travel fully up into the receiving position in the lubricator so that the reset bar or rod will cause the valve mechanism in the plunger to reset to the open condition.

In existing designs, the anvil which the plunger contacts upon arrival, as well as the reset bar or rod (when provided) are slidably mounted to an interior bore of the lubricator cap assembly. In the embodiments illustrated in FIGS. 1A-2C, a replaceable insert 175 is provided in the lubricator cap assembly 170, and the anvil is mounted on the replaceable insert 175. In the embodiments illustrated in FIGS. 3A-4E, a similar replaceable insert 275 is provided in the lubricator cap assembly 270, and the anvil is mounted on the replaceable insert 275. The replaceable inserts 175/275 serve to reduce the wear experienced by the anvil and the interior bore of the lubricator cap assembly 170/270, and may also absorb some of the shock generated by contact between the plunger and anvil. Further, these inserts 175/275 could be replaced when worn, as opposed to replacing a worn anvil or a worn portion of the lubricator cap assembly 170/270.

In the embodiment illustrated in FIGS. 3A-3D, the unitary body 200 includes an upwardly extending neck 207 upon which the lubricator cap assembly 270 is mounted. In the embodiment illustrated in FIGS. 4A-4D, the unitary body 300 lacks an upwardly extending neck 207. Instead, a mounting neck 209 with a flange 278 is bolted to the top of the unitary body 300. The lubricator cap assembly 270 is then attached to the mounting neck 209.

The embodiment illustrated in FIGS. 4A-4D may make it easier to access and perform maintenance and repair on the mechanisms within the lubricator cap assembly 270 and/or to access the internal passageways at the upper end of the unitary body 300. Further, the modular design of the embodiment illustrated in FIGS. 4A-4D may make it easier to replace the lubricator head assembly without replacing the unitary body 300, or to replace the unitary body 300 without replacing the lubricator head assembly 270.

Figure 7:
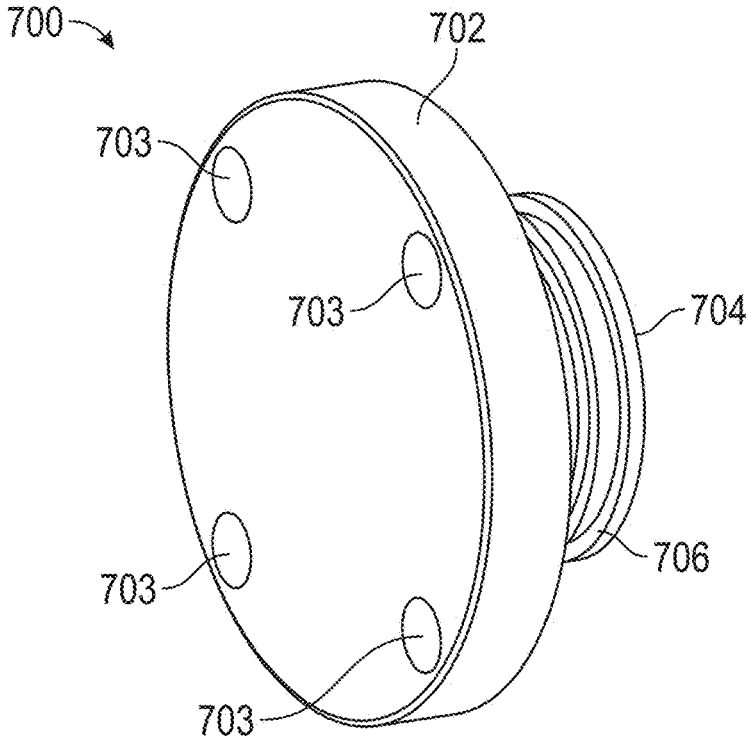
FIG. 7 is a perspective view of a blank plate that can be installed on an external aperture of a unitary wellhead flow block lubricator assembly as illustrated in FIGS. 3A-4B.

If a well is new and has good natural flow, there would be no need to employ a plunger. In this case, a blank plate 700 as illustrated in FIG. 7 can be mounted on the first opening on the lower portion of the front 201 of the unitary body 200/300 to cover the choke passageway 216. With no choke mechanism mounted, fluid is free to flow through the main passageway 220 and through one or more of the return passageways 242, 244 and 246, and then out through one or both of the first and second outflow passageways 212/214. Under these circumstances, it would not likely be desirable to install any flow restrictors to alter the flow though any of the internal passageways.

Figure 4E:
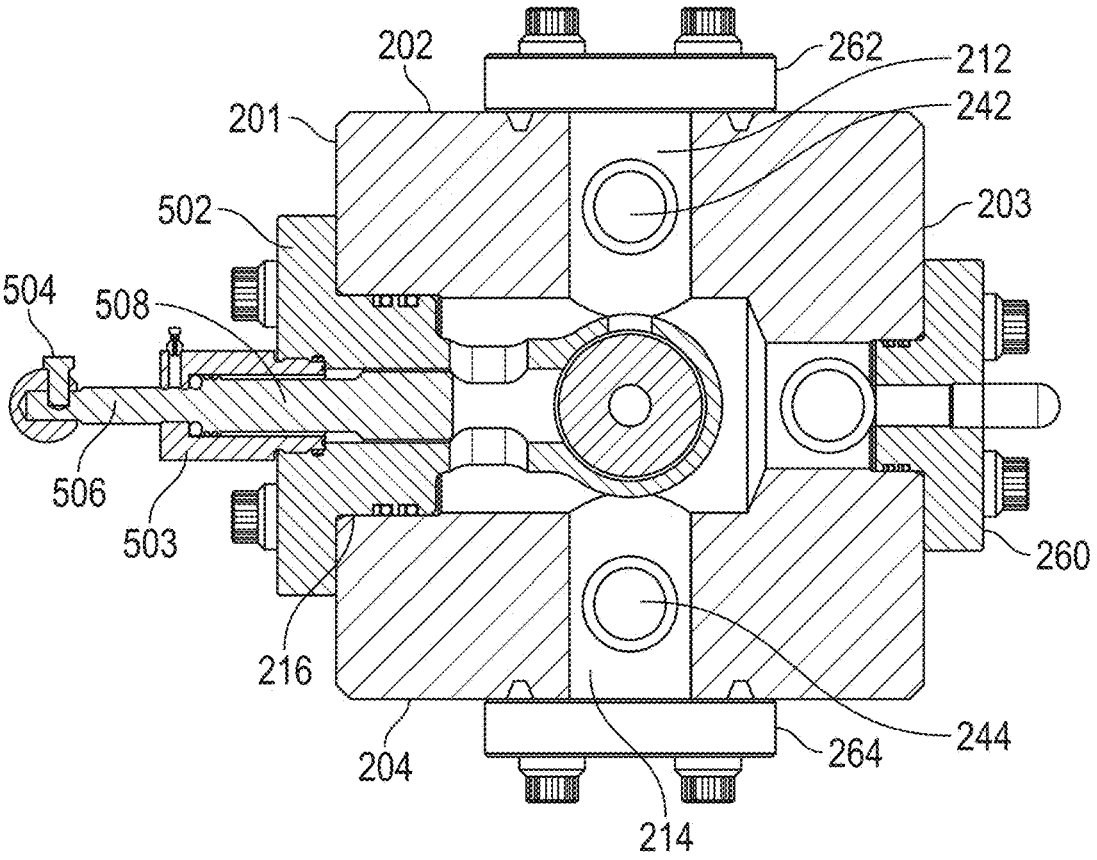
FIG. 4E and a cross-sectional view of a lower portion of a unitary wellhead flow block lubricator assembly as illustrated in FIGS. 3A, 3B or as illustrated in FIGS. 4A and 4B.

If a well no longer has good natural flow, and a plunger is being used, a choke mechanism 500 can be mounted in the choke passageway 216 of the unitary body 200/300, as illustrated in FIGS. 3C and 4C. The choke mechanism 500 can selectively reduce flow from the inlet passageway 222 into the first and second outflow passageways 212, 214 to thereby enhance flow of fluid up into the main passageway 220. Greater flow into the main passageway 220 helps to ensure the plunger travels into the receiving position in the main passageway 220. FIG. 4E illustrates a cross-sectional view taken through a lower portion of the unitary body 200/300 where the choke passageway 216, the first outflow passageway 212, the second outflow passageway 214 and the rear outflow passageway 218 are located. This view helps to illustrate how the integrated choke mechanism 500 can be used.

Figure 5A:
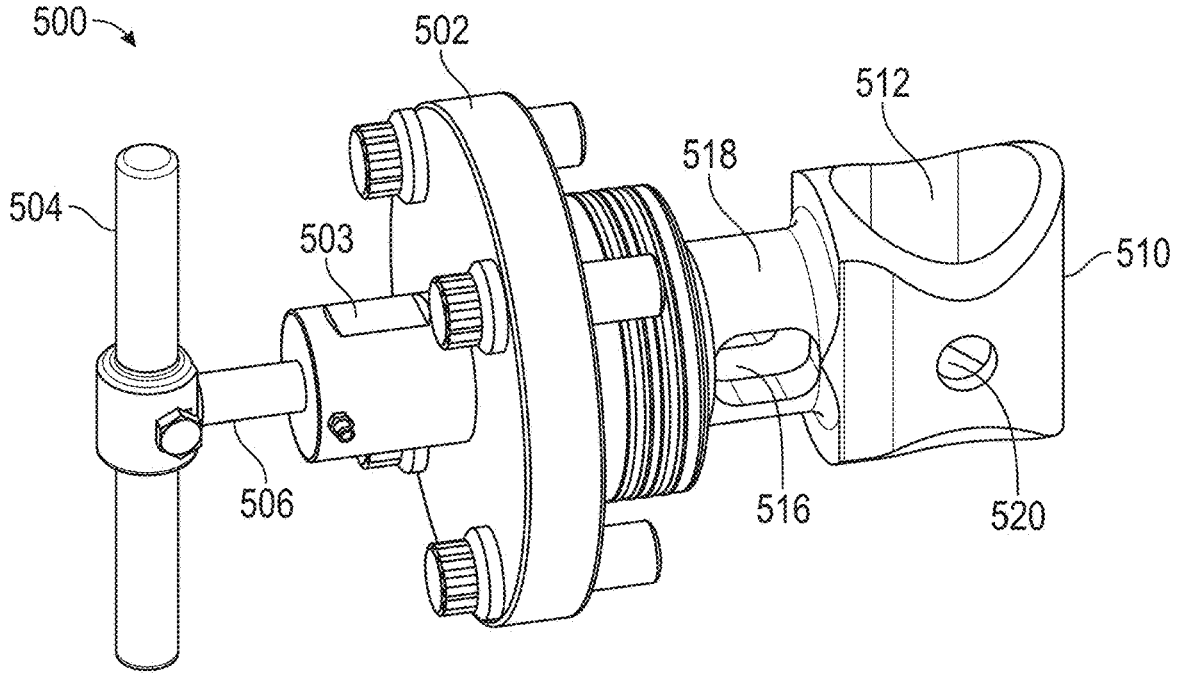
FIG. 5A is a perspective view of an integrated choke mechanism that can be installed in a unitary wellhead flow block lubricator assembly as illustrated in FIGS. 3A-4B.
Figure 5B:
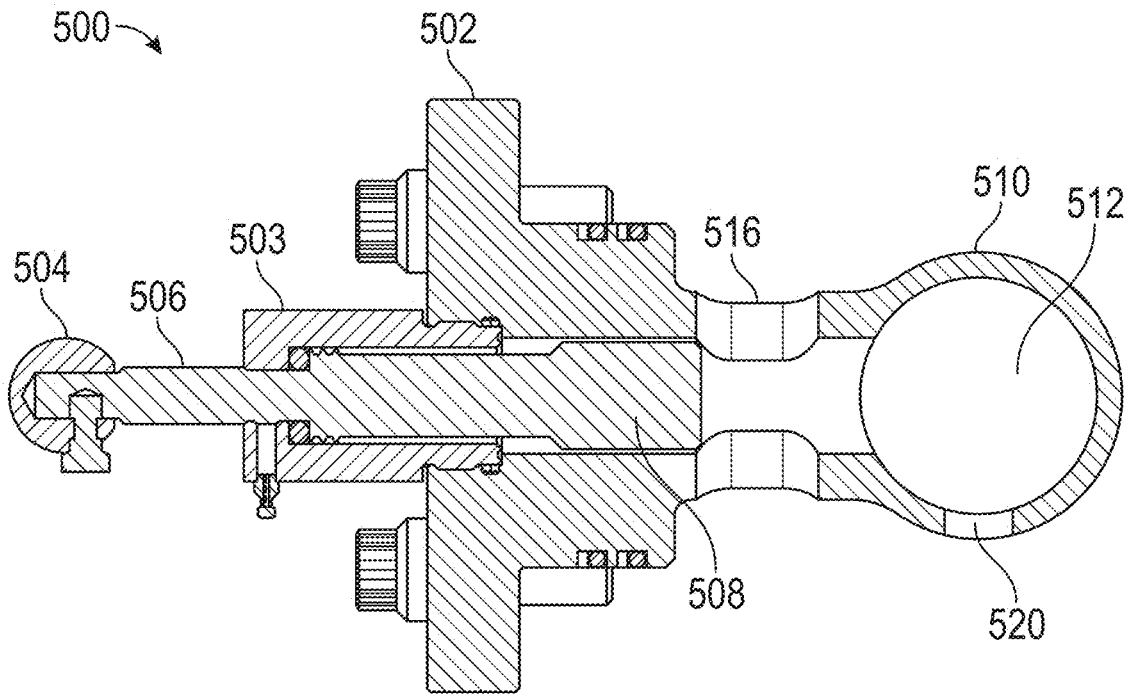
FIG. 5B is a cross-sectional view of the integrated choke mechanism illustrated in FIG. 5A.

The integrated choke mechanism 500 is illustrated in FIGS. 5A and 5B. The integrated choke mechanism 500 includes a flange 502 that can be bolted to the first opening on the lower portion of the front 201 of the unitary body 200/300. A flow control arm extends from the flange 502 into the interior of the unitary body 200/300. The flow control arm includes a cylindrical sleeve 510 with an interior bore 512. A pilot orifice 520 is located on one side of the cylindrical sleeve 510. When the flange 502 and control arm are mounted on the unitary body 200/300, the interior bore 512 of the cylindrical sleeve 510 is aligned with the inlet passageway 222 and the main passageway 220 of the unitary body 200/300. This allows a plunger to travel up through the inlet passageway 222, through the interior bore 512 of the cylindrical sleeve 510 and up into the main passageway 220.

Depending on how the choke mechanism 500 is mounted on the unitary body 200/300, the pilot orifice 520 can be aimed at the first outflow passageway 112 or the second outflow passageway 114. Typically, the pilot orifice 520 is pointed to the outflow passageway 112/114 connected to a production line. Regardless of which direction the pilot orifice 520 is pointed, the cylindrical sleeve 510 ensures that a considerable amount of the fluid exiting the inlet passageway 222 flows up into the main passageway 220.

FIGS. 5A and 5B also illustrate that the control arm of the choke mechanism 500 includes a reduced diameter portion 518 which is hollow and which includes side apertures 516 that lead into the hollow interior of the reduced diameter portion 518. As illustrated in FIG. 4E, the reduced diameter portion 518 and the apertures 516 ensure that any fluid flowing into the lower distribution block through either the inlet passageway 222 or the first, second and third return passageways 242, 244 and 246 can flow into the first and second outlet passageways 212, 214.

Fluid from the well that is traveling through the inlet passageway 222 flows into the cylindrical sleeve 510, and then into the hollow interior of the reduced diameter portion 518. The fluid can then escape the hollow interior of the reduced diameter portion through the apertures 516, at which point the fluid can travel out via one or both of the first and second outflow passageways 512, 514.

The choke mechanism 500 also includes a rotatably mounted flow restrictor 506 that is attached to a handle 504. The flow restrictor 506 has external threads that engage with internal threads of a mounting stem 503. Rotating the flow restrictor 506 in one direction will cause a tip 508 of the flow restrictor to protrude into the hollow interior of the reduced diameter portion 518, which blocks flow of fluid out of the apertures 516 on the reduced diameter portion 518. Thus, turning the handle 504 of the choke mechanism allows one to selectively vary the amount of fluid that can flow from the inlet passageway 222 to the outlet passageways 212/214 via the hollow interior of the reduced diameter portion 518. This, in turn, selectively varies the amount of fluid flowing from the inlet passageway 222 up into the main passageway 220.

An integrated choke mechanism as depicted in FIGS. 5A and 5B can be used on the embodiments of a flow block and lubricator assembly illustrated in FIGS. 1A-2C as well as on the embodiments of a unitary flow block lubricator assembly depicted in FIGS. 3A-4E.

Figure 6A:
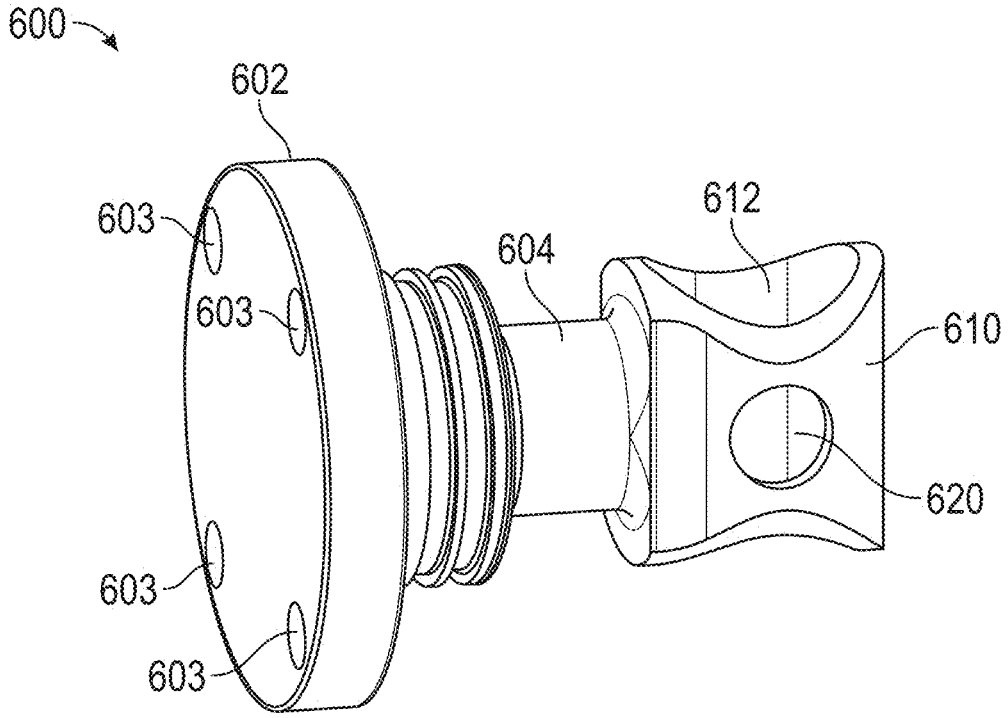
FIG. 6A is a perspective view of a lower outlet flow restrictor that can be installed in a unitary wellhead flow block lubricator assembly as illustrated in FIGS. 3A-4B.
Figure 6B:
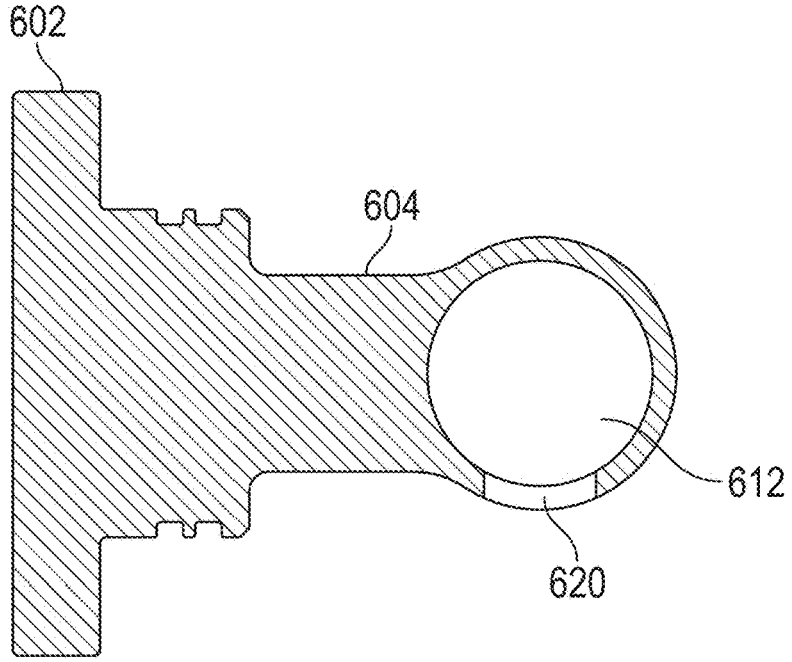
FIG. 6B is a cross-sectional view of the lower outlet flow restrictor illustrated in FIG. 6A.

FIGS. 6A and 6B illustrate a lower flow outlet assembly 600 that could be used in place of the integrated choke mechanism 500 described above. The lower flow outlet assembly 600 could also be mounted on the embodiments of a flow block and lubricator assembly illustrated in FIGS. 1A-2C as well as on the embodiments of a unitary flow block lubricator assembly depicted in FIGS. 3A-4E.

The lower flow outlet assembly 600 includes features similar to the choke mechanism 500 depicted in FIGS. 5A and 5B, but lacks a movable flow restrictor 506. The lower flow outlet assembly 600 still includes a flange 602 with bolt holes 603 that allow the flow controller 600 to be mounted in two different rotational orientations. The flow controller 600 also includes a cylindrical sleeve 610 with a central bore 612, as well as a pilot orifice 620. The lower flow outlet assembly 600 also includes a reduced diameter portion 604, but that reduced diameter portion 604 is not hollow. The design of the lower flow outlet assembly 600 allows fluid entering the lower distribution block from the inlet passageway 222 or the first, second and third return passageways 242, 244 and 246 to flow out the first and second outflow passageways 212, 214. However, the lower flow outlet assembly ensures that the majority of the flow in the inlet passageway is routed up into the main passageway 220, thereby helping to ensure a plunger will be carried fully up into the receiving position in the main passageway 220.

While the choke mechanism 500 or lower flow outlet assembly 600 can be used to selectively control the flow of fluid into and out of the lower distribution block, various other flow restricting devices can be used to control the flow of fluid through other passageways of the unitary body 200/300. Examples of some flow control devices are shown in FIGS. 7, 9A-9C and 10. These flow control devices are configured to be bolted or mounted to the unitary body 200/300 so that they cover an opening on an external surface of the unitary body 200/300 that leads to one of the internal passageways.

If one does not wish to impose any flow restrictions on an internal passageway of the unitary body 200/300, a blank plate 700 as illustrated in FIG. 7 could be mounted to an opening on the external surface of the unitary body that leads to an internal passageway. The blank plate 700 includes a flange 702 with bolt holes 703. A small cylindrical protrusion 704 extends away from the internal side of the flange 702 and that would extend into a hole in the unitary body 200/300 to which the blank plate 700 is mounted. The cylindrical protrusion 704 may include one or more seal elements 706 that would seal against the interior bore of the hole in the unitary body 200/300 to which the blank plate 700 is mounted.

Similarly, a blank plate 700 could be mounted to the first manifold 142 depicted in FIGS. 1A and 1B and/or to the second manifold as depicted in FIGS. 2A and 2B. This would allow fluid in these embodiments to flow freely from the main passageway 122, through the upper passageways and then through the return passageways 140, 148.

Figure 9A:
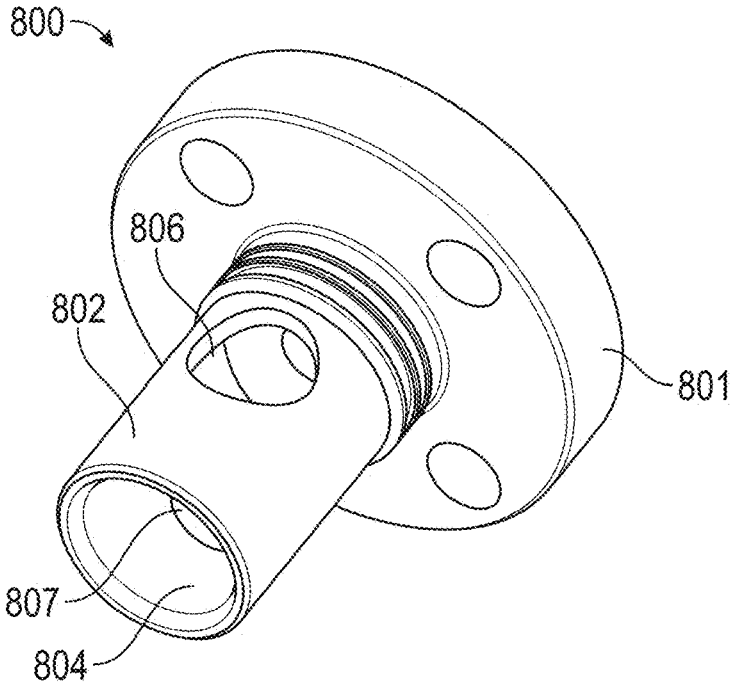
FIG. 9A is a perspective view of a first embodiment of a flow restrictor than can be mounted to an exterior of a flow block and lubricator assembly as illustrated in FIGS. 1A-2C or a unitary wellhead flow block lubricator assembly as illustrated in FIGS. 3A-4B.

If one wishes to restrict the flow of fluids and gasses through the return passageways 242, 244, 246, one can install a flow restrictor 800 as depicted in FIG. 9A over one of the upper openings on the main body. The flow restrictor 800 has a flange 801 and a hollow cylindrical pipe 802 that extends from the flange 801. A first flow aperture 806 having a first diameter is formed in the cylindrical pipe 802. A second flow aperture 807 is also formed in the cylindrical pipe 802 at a position 180° opposite the first flow aperture 806. The second flow aperture 807 has a smaller diameter than the first flow aperture 806. The end 804 of the cylindrical pipe is open.

Figure 8:
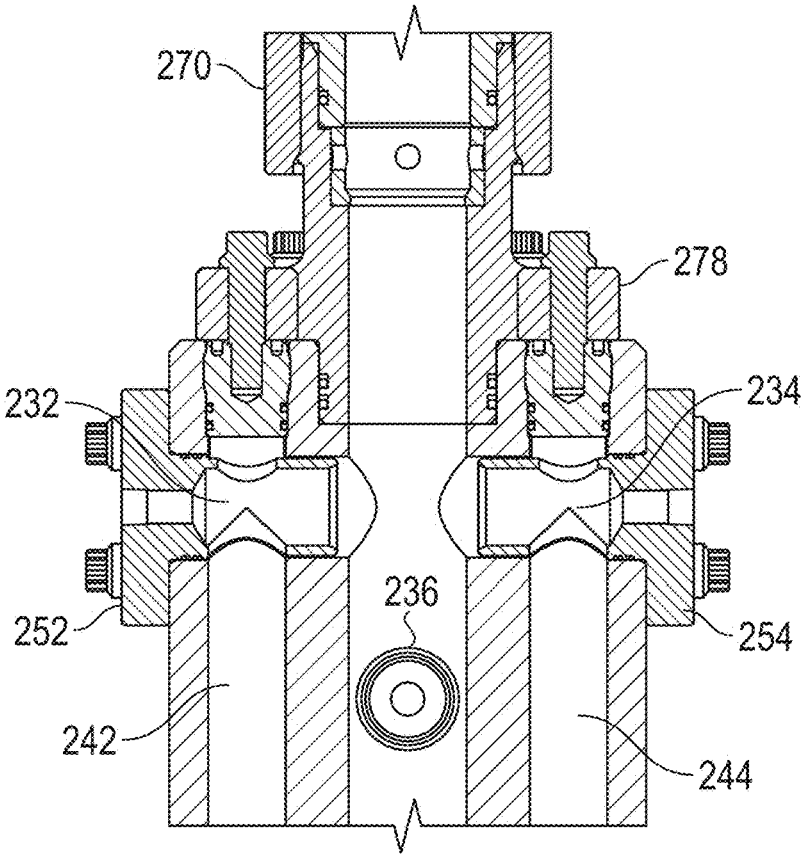
FIG. 8 is a cross-sectional view of an upper portion of a unitary wellhead flow block lubricator assembly as illustrated in FIGS. 4A and 4B illustrating an upper distribution block.
Figure 9B:
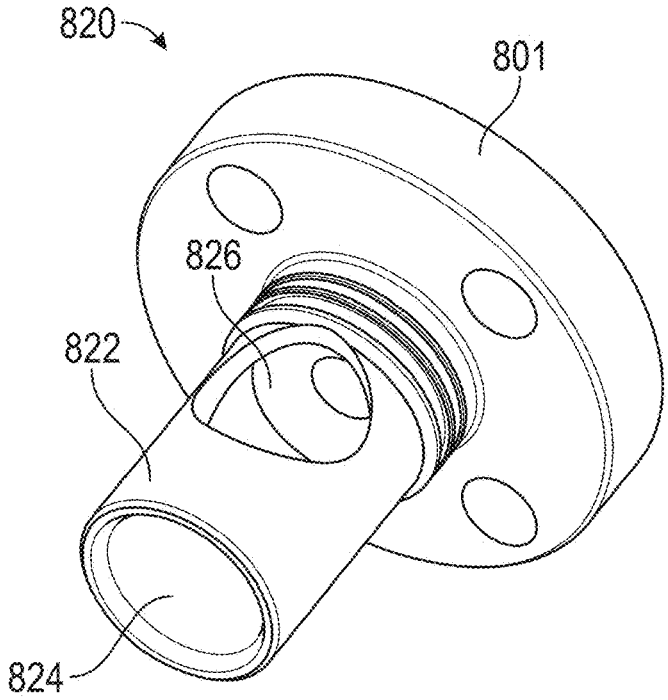
FIG. 9B is a perspective view of a second embodiment of a flow restrictor than can be mounted to an exterior of a flow block and lubricator assembly as illustrated in FIGS. 1A-2C or a unitary wellhead flow block lubricator assembly as illustrated in FIGS. 3A-4B.
Figure 9C:
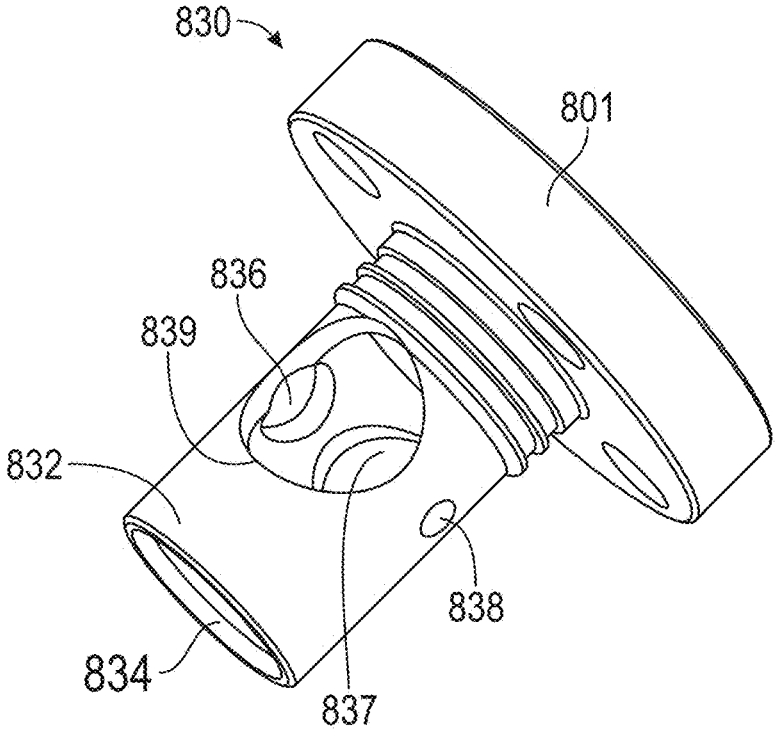
FIG. 9C is a perspective view of a third embodiment of a flow restrictor that can be mounted to an exterior of a flow block and lubricator assembly as illustrated in FIGS. 1A-2C or a unitary wellhead flow block lubricator assembly as illustrated in FIGS. 3A-4B.

If one wishes to restrict the flow of fluid in one of the return passageways 242, 244, 246 of the embodiments illustrated in FIGS. 3A-4E, one could mount one of the flow restrictors illustrated in FIGS. 9A-9C in one or all of the upper openings of the unitary body 200/300. FIG. 8 shows an example of how flow restrictors 252, 254 can be mounted over upper openings on the first and second sides of the main body such that the cylindrical protrusions of the flow restrictors 252, 254 extend into the first and second upper passageways 232, 234. The size of the openings on the lower sides of the cylindrical pipe 802 that face down into the first and second return passageways 242, 244 will determine the amount of flow restriction that is applied to fluids and gasses flowing from the upper distribution block into the first and second return passageways 242, 244.

When a flow restrictor 800 as depicted in FIG. 9A is mounted in the first upper opening of the unitary body 200/300, the cylindrical pipe 802 will extend down into the first upper passageway 232. If the flow restrictor 800 is mounted in a first rotational orientation such that the first flow aperture 806 is aligned with the first return passageway 242, fluid can flow from the upper distribution block, through the first flow aperture 806, and down into the first return passageway 242. However, the diameter of the first flow aperture 806 will impose a first flow restriction on the flow of fluid from the upper distribution block down into the first return passageway 242. This would generate a first level of backpressure in the main passageway, and that backpressure may help to ensure that a plunger arriving in the main passageway 220 travels fully up into the receiving location in the main passageway 220.

If the flow restrictor 800 is instead mounted in a second rotational orientation such that the second smaller flow aperture 807 is aligned with the top of the first return passageway 242, the second smaller diameter aperture 807 will impose a greater flow restriction on fluid flowing from the upper distribution block down into the first return passageway 242 than the first flow aperture 806. This would create a greater level of backpressure in the main passageway of the unitary body 200/300. The greater backpressure would provide even more force on the plunger to ensure the plunger travels fully up in the main passageway to the receiving location in the main passageway 220.

In the case of the embodiments illustrated in FIGS. 1A-2C, one could restrict the flow of fluid through the first return passageway 140 by mounting one of the flow restrictors illustrated in FIGS. 9A-9C in the first return manifold 142. In the embodiment illustrated in FIGS. 2A-2C, one could restrict the flow of fluid through the second return passageway 148 by mounting one of the flow restrictors illustrated in FIGS. 9A-9C in the second return manifold 146.

FIG. 9B illustrates a second embodiment of a flow restrictor 820 that is similar to the one illustrated in FIG. 9A. In this second embodiment, a single flow aperture 826 in the cylindrical pipe 822 has a larger diameter than the first flow aperture 806 or the second flow aperture 807 in the first embodiment illustrated in FIG. 9A. Also, there is no second flow aperture opposite the large diameter flow aperture 826. An operator could replace a first flow restrictor 800 as depicted in FIG. 9A with a second flow restrictor 820 as depicted in FIG. 9B to reduce the restriction on flow of fluid into the first return passageway 242, or to block all flow into the first return passageway 242.

If the second flow restrictor 820 is mounted in the first upper opening of the unitary body 200/300 such that the large diameter flow aperture 826 is aligned with the upper end of the first return passageway 242, the flow from the upper distribution block, through the large diameter flow aperture 826, and down into the first return passageway 242 would be even less restricted than when the first flow restrictor 800 depicted in FIG. 9A was mounted. This would decrease the backpressure in the main passageway 220, which could increase the flow rate out of the well.

Alternatively, if the second flow restrictor 820 is mounted in the first upper opening of the unitary body 200/300 in a rotational orientation in which the closed wall portion of the cylindrical wall 822 opposite the large diameter flow aperture 826 is aligned with the upper end of the first return passageway 242, flow from the upper distribution block and down into the first return passageway 242 would be blocked. This would serve to increase the backpressure in the main passageway 220 even more than when the first flow restrictor 800 depicted in FIG. 9A was mounted. This may be desirable to ensure that the plunger travels fully up into the receiving location in the main passageway 220.

FIG. 9C illustrates a third embodiment of a flow restrictor 830 that includes four different sized flow apertures 836, 837, 838 and 839 on the cylindrical pipe 832. An operator can install the third flow restrictor 830 in any of four different rotational orientations to align a selected one of the flow apertures 836, 837, 838 and 839 with the first return passageway 242 to selectively vary a flow rate of fluid from the upper distribution block down into the first return passageway 242. This allows an operator to selectively vary the flow of fluid to the passageways to optimize the operational condition of the well.

Flow restrictors as depicted in FIGS. 7 and 9A-9C make it possible to easily and quickly vary a fluid flow rate through one or more of the internal passageways of the unitary body 200/300 in the embodiments illustrated in FIGS. 3A-4E. The flow restrictors can also enable an operator to selectively vary a flow rate through the main passageway 122 and the first and second return passageways 140, 148 of the embodiments illustrated in FIGS. 1A-2C. This makes is easy and quick for operators to adapt the wellhead flow block lubricator assemblies to changing operational conditions.

Returning to FIGS. 3A-3D, in this embodiment, a first flow restrictor 252 is mounted over the first upper opening such that the cylindrical pipe of the flow restrictor 252 extends into the first upper passageway 232. A second flow restrictor 254 is mounted over the second upper opening such that the cylindrical pipe of the second flow restrictor 254 extends into the second upper passageway 234. A third flow restrictor 256 is mounted over the third upper opening such that the cylindrical pipe of the third flow restrictor 256 extends into the third upper passageway 236. Further, a fourth flow restrictor 260 is mounted over the fourth lower opening on the rear side of the main body so that the cylindrical pipe of the fourth flow restrictor 260 extends into the lower passageway 218. A similar arrangement of flow restrictors are mounted to the main body of the embodiment depicted in FIGS. 4A-4D.

Figure 10:
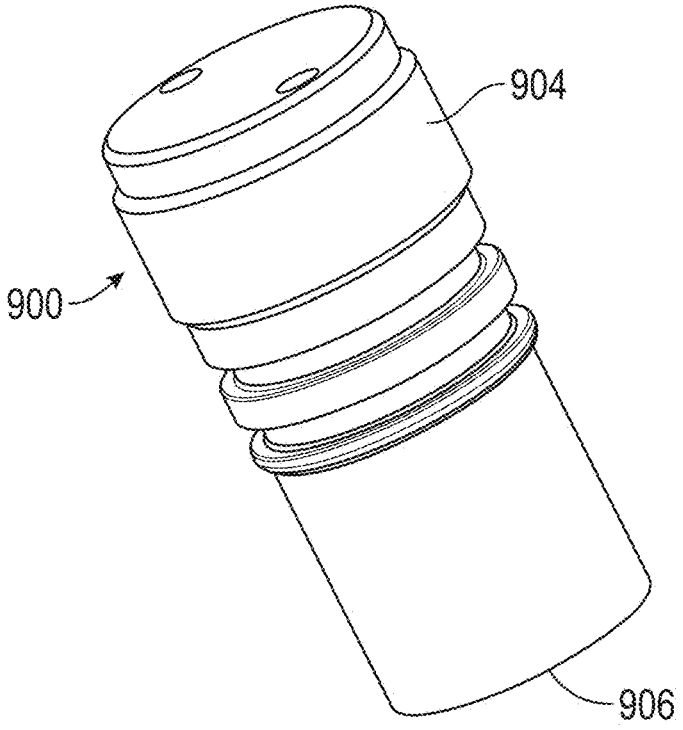
FIG. 10 is a perspective view of a choke plug that could be installed on an exterior of a flow block and lubricator assembly as illustrated in FIGS. 1A-2C or a unitary wellhead flow block lubricator assembly as illustrated in FIGS. 3A-4B.
Figure 11:
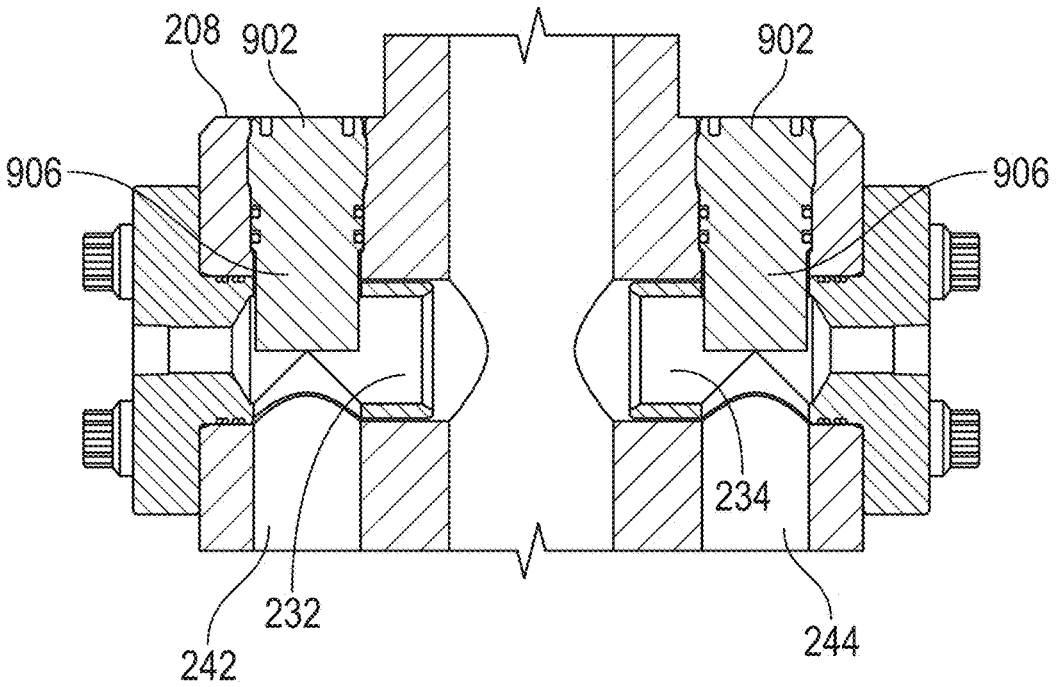
FIG. 11 is a cross-sectional view of an upper portion of a unitary wellhead flow block lubricator assembly as illustrated in FIGS. 3A and 3B showing choke plugs as illustrated FIG. 10 installed in the top of the unitary body.

FIGS. 10 and 11 illustrate another alternate way of controlling the flow rate of fluid through one or more of the internal passageways of the unitary body 200/300. This way of controlling flow through the passageways makes use of plugs which are mounted in holes that are formed in the top of the unitary body 200/300 of the embodiments depicted in FIGS. 3A-4E.

As shown in FIGS. 3C, 3D, 4C and 4D, in order to form the first, second and third return passageways 242, 244, 246, it is necessary to drill down into the top 208 of the block of material that forms the unitary body 200/300. The upper portions of those holes in the top 208 of the unitary body 200/300 are then sealed with plugs. In the first embodiment illustrated in FIGS. 3C and 3D, the plugs 274 have a flat, featureless top surface. In the second embodiment illustrated in FIGS. 4C and 4D, the top of the plugs 276 are tapped with internal threads. The flange 278 of the mounting neck 209 can then be attached to the top 208 of the unitary body 300 by bolts that extend down through the flange 278 and engage the internal threads in the plugs 276. Because of where the plugs 274/276 are located, it would be possible for the plugs to extend downward enough to block flow through the first and second upper passageways 232, 234 in the unitary body 200/300.

FIG. 10 depicts a flow restrictor plug 900 that could be mounted in one of the apertures in the top 208 of the unitary body 200/300 that were created when the holes for the first and second return passageways 242, 244 were formed. The flow restrictor plug 900 includes a head 904 that would be mounted in an aperture in the top 208 of the unitary body 200/300 A bottom 906 of the flow restrictor plug 900 would then extend down into a passageway to partially or fully block the flow of fluid through the passageway.

FIG. 11 shows how flow restrictor plugs 900 could be mounted in the apertures in the top 208 of the unitary body 200/300 that lead into the first and second upper flow passageways 232, 234. The bottom portions 906 of the flow restrictor plugs 900 extend down into the first and second upper flow passageways 232, 234 to partially block the flow of fluid through the first and second upper passageways 232, 234, thereby restricting the flow of fluid from the upper distribution block down into the first and second return passageways 242, 244. The length of the flow restrictor plugs 900 can be varied to selectively vary how much of the first and second upper passageways 232, 234 are blocked, and thus how much flow into the first and second return passageways is reduced.

The unitary wellhead flow block lubricator assembly described above provides for multifunctional use. When a well has good natural flow without the need for a plunger, a blank plate 700 as illustrated in FIG. 7 can be mounted over the choke passageway 216 and the unitary wellhead flow block lubricator assembly can be used as a traditional flow block. In this configuration, it may not be necessary to provide any of the plunger handling mechanisms in the lubricator cap assembly 270 or a plunger catcher mechanism 230.

When well production declines and it becomes advantageous to begin using a plunger, the blank plate 700 can be replaced with a choke mechanism 500 or a lower flow outlet assembly 600. Also, if not already present, the plunger handling mechanisms can be added to the lubricator cap assembly 270 and the plunger catcher 230 can be added to the lubricator assembly. The unitary wellhead flow block lubricator assembly can then be used in connection with plunger assist operations to optimize production.

When the unitary wellhead flow block lubricator assembly is used in connection with a plunger, a blank plate 700 and the various flow restrictors 800, 820, 830 illustrated in FIGS. 9A-9C can be used to control the flow of fluids and gas though the internal passageways, and in particular the return passageways 242, 244, 246, to thereby control the movement and speed of movement of the plunger as it arrives in the unitary body 200/300. The blank plate 700 and the flow restrictors 800, 820, 830 can be easily removed for inspection and repair of both themselves and the passageways, and to remount one of the flow restrictors 800, 820, 830 in a different rotational orientation to alter the flow through one or more passageways of the unitary body 200/300.

The foregoing descriptions explained how one or more choke mechanisms can be mounted on various parts of a unitary wellhead flow block lubricator. Some of the choke mechanisms can be selectively adjusted to allow greater or lesser amounts of fluid and/or gas to flow through a passageway. In the embodiments illustrated in the drawings, the choke mechanisms are manually adjustable. However, alternate embodiments could be selectively adjusted via an electric motor, via pneumatic or hydraulic means or via other control mechanisms. Thus, any references to a choke mechanism should be interpreted to include manually adjustable choke mechanisms, as well as choke mechanisms that incorporate electrical, pneumatic and/or hydraulic control systems.

In the foregoing embodiments, a wellhead flow block lubricator included a lower distribution block and an upper distribution block, both of which were located within a body of the flow block lubricator. At least one return passageway extends through the body to connect the upper distribution block and the lower distribution block. The return passageway extends vertically through the flow block adjacent a first side, a second side, or a rear side of the body.

FIGS. 12A-12E illustrate an alternate embodiment of a wellhead flow block lubricator 1000 which includes an upper distribution block and an interim distribution block, both of which are located above a lower distribution block. The upper distribution block still includes upper passageways that extend from a main passageway to at least one return passageway passing through the body of the flow block lubricator. The interim distribution block also includes passageways that extend from the main passageway to at least one return passageway. The interim passageways extend outward to a set of interim openings on the first side, the second side and the rear side of the body.

Figure 12A:
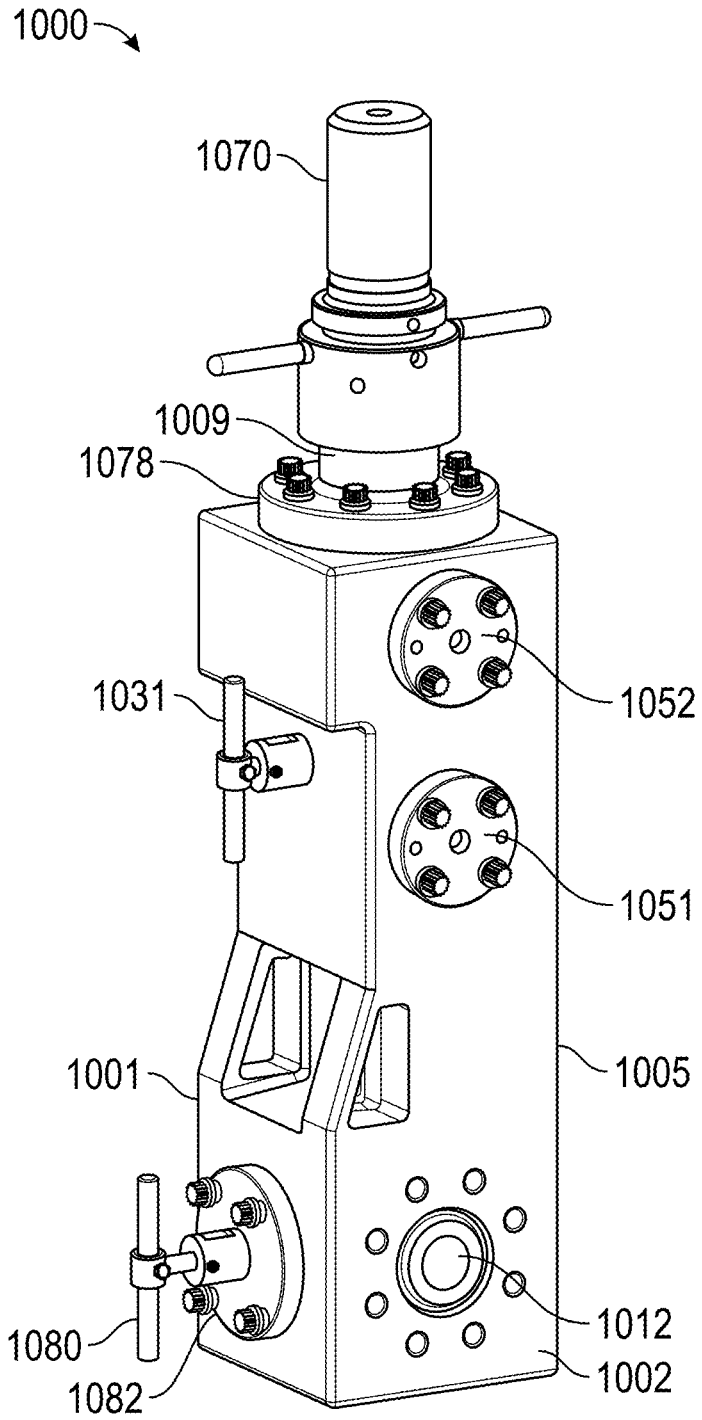
FIG. 12A is a perspective view of another embodiment of a unitary wellhead flow block lubricator assembly that includes an interim distribution block.

FIG. 12A provides a perspective view of the alternate embodiment of a flow block lubricator 1000. The flow block lubricator 1000 includes a body which includes a front side 1001, a first side 1002, a second side 1004, and a rear side 1005. As with the previous embodiments, a choke mechanism 1080 is installed over a first opening on the lower part of the front side 1001 of the body. In addition, a plunger catcher mechanism 1031 is mounted on the front side 1001 of the body an interim or upper portion of the body.

Figure 12C:
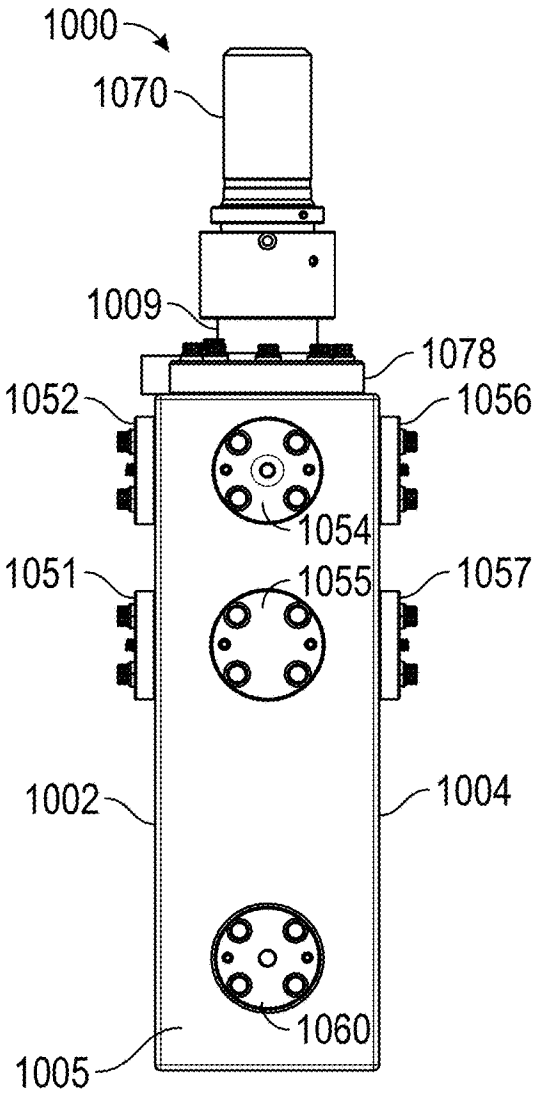
FIG. 12C is a rear view of the wellhead flow block lubricator illustrated in FIG. 12A.
Figure 12B:
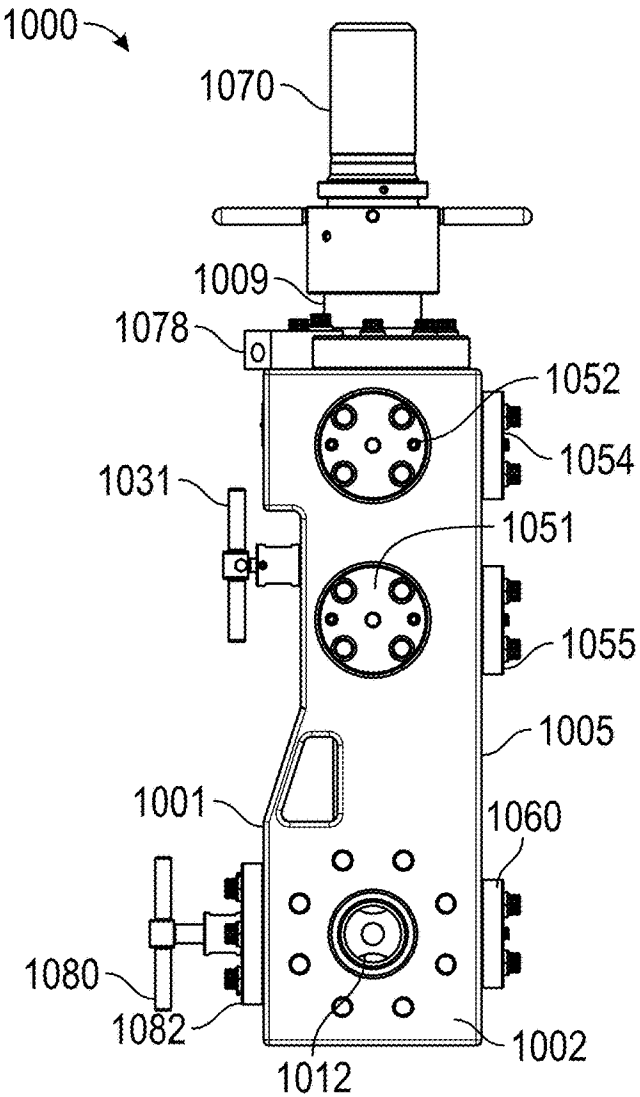
FIG. 12B is a right side view of the wellhead flow block lubricator illustrated in FIG. 12A.
Figure 12D:
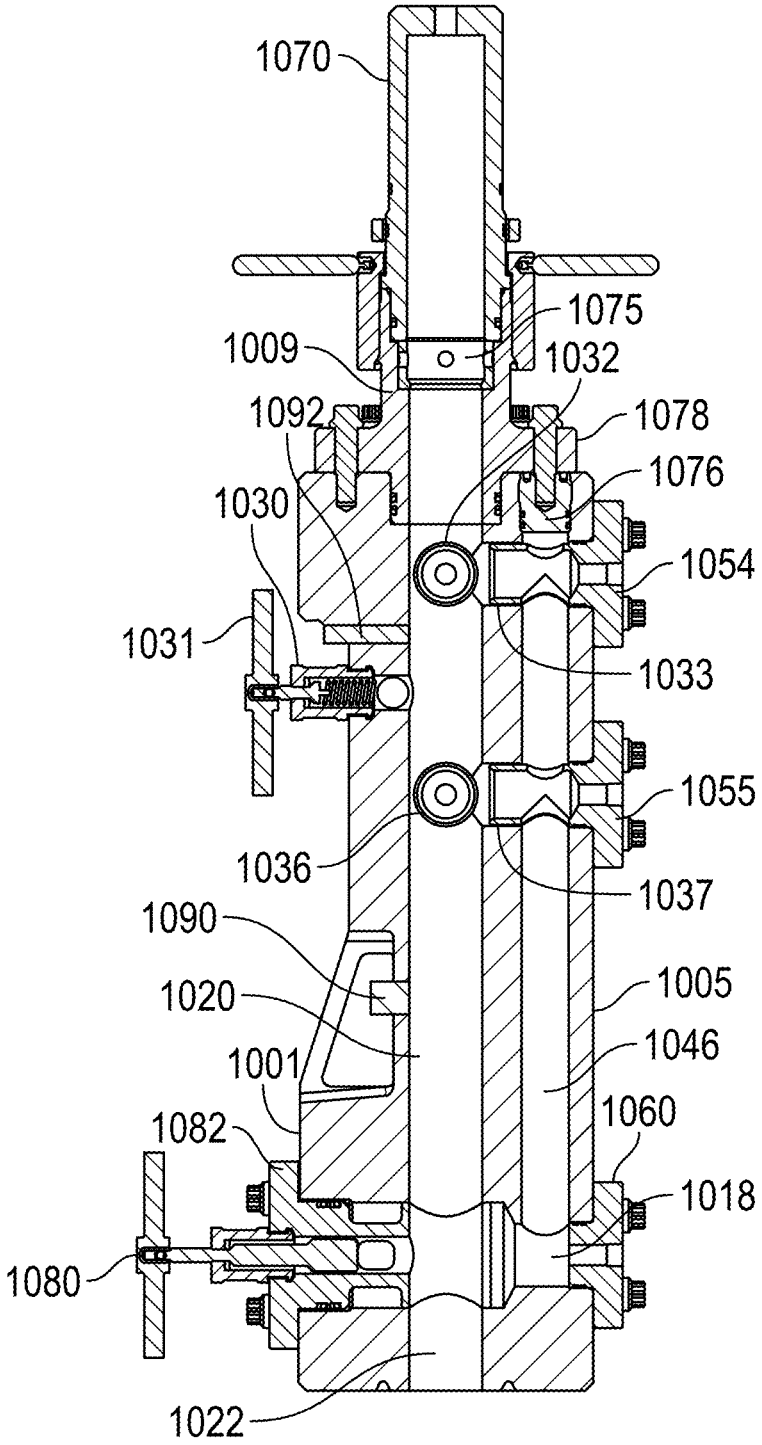
FIG. 12D is a first cross-sectional view of the wellhead flow block lubricator illustrated in FIG. 12A.
Figure 12E:
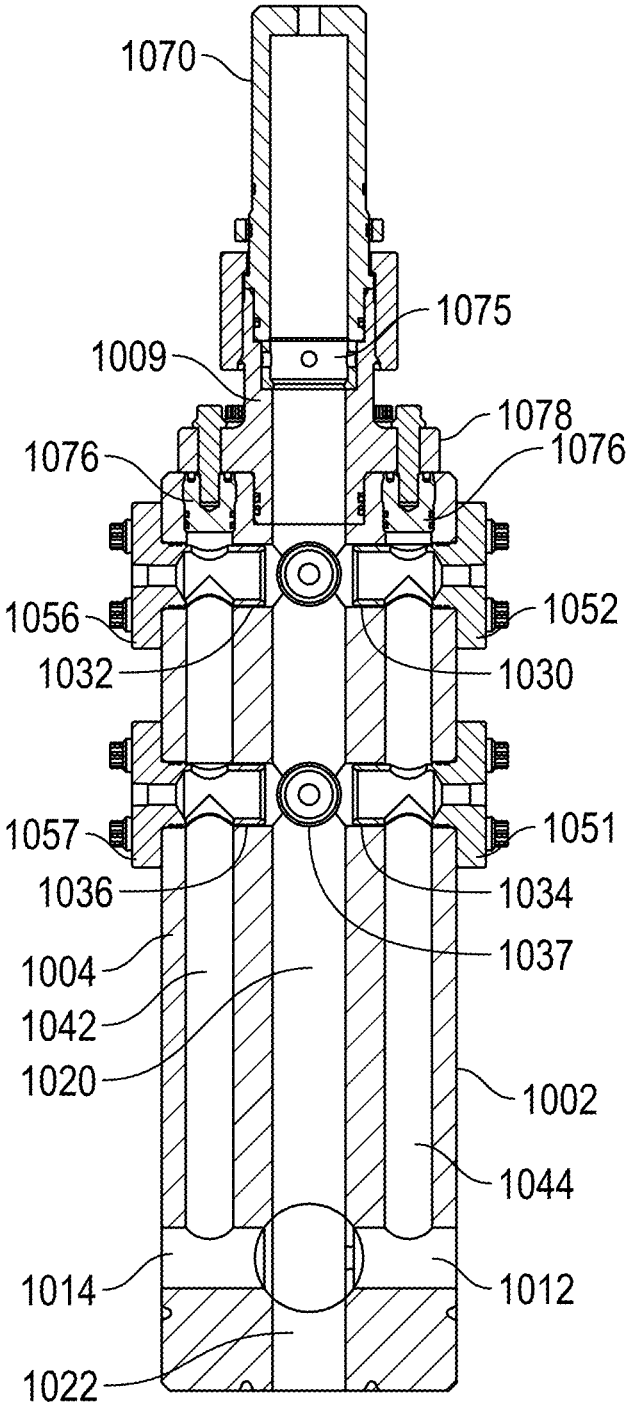
FIG. 12E is a second cross-sectional view of the wellhead flow block lubricator illustrated in FIG. 12A.

As illustrated in the cross-sectional views of FIGS. 12D and 12E, an inlet passageway 1022 is provided on the bottom of the body of the flow block lubricator 1000. The inlet passageway 1022 is aligned with a main passageway 1020 which extends up to the upper portion of the body. A lower distribution block is located between the inlet passageway 1022 and the main passageway 1020. The lower distribution block includes a first outflow passageway 1012 that extends to the first side 1002 of the body, as well as a second outflow passageway 1014 which extends outward to the second side 1004 of the body. A rear outflow passageway 1018 extends from the lower distribution block rearward to the rear side 1005 of the body.

An upper distribution block provided at the upper end of the body includes a first upper passageway 1030 which extends from the main passageway 1020 out to the first side 1012 of the body. The upper distribution block also includes a second upper passageway 1032 which extends from the main passageway 1020 to an opening on the second side 1004 of the body. A third upper passageway 1033 extends from the main passageway 1020 to an opening on the rear side 1005 of the body.

The interim distribution block includes a first interim passageway 1034 which extends from the main passageway 1020 to an opening on the first side 1002 of the body. The interim distribution block also includes a second interim passageway 1036 which extends from the main passageway 1020 to an opening on the second side 1004 of the body. In addition, the interim distribution block includes a third interim passageway 1037 which extends from the main passageway 1020 to an opening on the rear side 1005 of the body.

As with the previous embodiments, a plurality of flow control inserts can be mounted over the openings on the exterior surfaces of the interim and upper portions of the body. The flow control inserts would extend into the passageways that form the upper distribution block, the interim distribution block or blocks, and the lower distribution block. The flow control inserts can operate to selectively control the flow of gases and fluid from a main passageway 1020 to return passageways 1042, 1044, and 1046 of the flow block lubricator.

In the embodiment illustrated in FIGS. 12A-12E, the flow control inserts mounted on the upper portion of the body include a first upper flow control insert 1052 mounted over the upper opening provided on the first side 1002 of the body. There is also a second upper flow control insert 1056 mounted over the upper opening on the second side 1004 of the body. Further, there is a third upper flow control insert 1054 mounted on the upper opening on the rear side 1005 of the body.

The flow block lubricator also includes a first interim flow control insert 1051 mounted over an opening on a middle portion of the first side 1002 of the body. There is also a second interim flow control insert 1057 mounted over an opening on a middle portion of the second side 1004 of the body. Further, there is a third interim flow control insert 1055 mounted over an opening on a middle portion of the rear side 1005 of the body.

As depicted in FIGS. 12C and 12D, a first lower flow control insert 1060 can be mounted over a lower opening that extends into the rear outflow passageway 1018, which is a part of the lower distribution block.

All of the flow control inserts can be of the same type, or they can be of different types. For example, the flow control inserts could be similar to the ones depicted in FIGS. 9A, 9B and 9C of the application. Each of those flow control inserts provides some degree of restriction of the flow through the associated passageways. Alternatively, the flow control inserts could be simply a blank plate 700 as depicted in FIG. 7. The blank plate 700 would provide no degree of restriction on the flow through the associated passageways. The flow control inserts could also be like the ones depicted in FIGS. 15A-15C, as will be discussed in greater detail below. This type of a flow control insert can include a flow control plug 1310 like the ones depicted in FIGS. 16A-16D that is screwed into the flow control insert to provide a selected degree of restriction on the flow through the associated passageways. In some embodiments, the flow control insert would not include a flow control plug 1310. In other embodiments, a variety of different flow control plugs 1310 can be screwed into the flow control inserts to provide varying levels of flow restriction, as will be discussed in greater detail below.

The interim distribution block, with the associated interim passageways 1034, 1036, 1037 extending between the main passageway 1020 and the return flow passageways 1044, 1042 and 1046 allows for greater control over a plunger which is being used within the wellbore of the well to which the flow block lubricator is mounted. For example, if the well is producing fluid and gas under considerable pressure, that pressure will tend to cause a plunger traveling up through the wellbore to arrive at the lubricator with great speed and momentum. This would typically mean that the lubricator will rise into the top of the well head flow block lubricator and strike a replaceable insert 1075 located in the lubricator cap assembly 1070 with great force. This can cause damage to the plunger as well as damage to the insert 1075 and the lubricator itself.

By providing an interim distribution block, it is possible to bleed off some of the pressure driving upward movement of the plunger before the plunger actually arrives at the top of the lubricator and strikes the replaceable insert 1075. This blead off of pressure can reduce the speed and momentum of the plunger before it strikes the replaceable insert 1075, which helps to prevent damage to the plunger and to the lubricator.

Conversely, if the well does not have considerable pressure driving the plunger upward within the wellbore, it may be difficult for the plunger to arrive to the very top of the lubricator. If the plunger stalls out part way up the lubricator, control over movements of the plunger may be lost. In addition, it is necessary for the plunger to arrive fully at the top of the lubricator to reset the internal valve of the plunger so the plunger can descend back into the wellbore for another cycle. If the plunger does not fully arrive at the top of the lubricator, and the internal valve of the plunger is not reset, the plunger may not be capable of descending back down the wellbore for another cycle.

Under these circumstances, it may be desirable to place considerable flow restriction at the interim distribution block level, so that the existing pressure in the well drives the plunger as far up towards the top of the lubricator as possible before pressure is bled off and fluid is allowed to return through the return flow passageways 1042, 1044, 1046. In this instance, the interim flow control inserts 1051, 1057 and 1055 would be provided with considerable flow restrictions to help insure that the plunger arrives fully at the top of the lubricator so that the internal valve of the plunger can be reset.

By providing the lubricator with both an upward distribution block with associated flow control inserts and an interim distribution block with associated flow control inserts, one is able to provide a greater degree of control over movements of a plunger over the life cycle of a well. When the well is relatively new and is producing fluid and gases under considerable pressure, the flow control devices can be set up to provide no or only a minimal degree of flow restriction which results in the plunger speed and momentum being quickly bled off via the interim distribution block when the plunger arrives at the top of the lubricator. As the well begins to lose pressure, the flow control inserts can be changed or modified to provide a greater degree of flow restriction, at least at the interim distribution block level, which helps to ensure that the plunger will still arrive at the top of the lubricator. When the well is towards the end of its lifecycle and is producing very little pressure, the flow restrictions provided by the flow control inserts in the upper and interim distribution blocks can be selectively adjusted to provide greater flow restriction, thereby helping to ensure that the existing low pressure is still sufficient to drive the plunger fully to the top of the lubricator.

In the embodiment illustrated in FIGS. 12A-12E the body of the flow block includes a main passageway 1020, a first return flow passageway 1044, a second return flow passageway 1042, and a third return flow passageway 1046. In alternate embodiments, only a single return passageway or only two return flow passageways could be provided in the body of the flow block lubricator. Thus, the depiction of the flow block lubricator with three return flow passageways should not be considered limiting.

FIGS. 13A-13E illustrate another alternate embodiment of a flow block lubricator. This embodiment is similar to the embodiment illustrated in FIGS. 12A-12E in that it includes both an upper distribution block and an interim distribution block having passageways that lead to openings on the first, second and rear sides of the of the upper and interim portions of the body. However, this embodiment further includes a second interim distribution block located between the first interim distribution block and the lower distribution block.

Figure 13A:
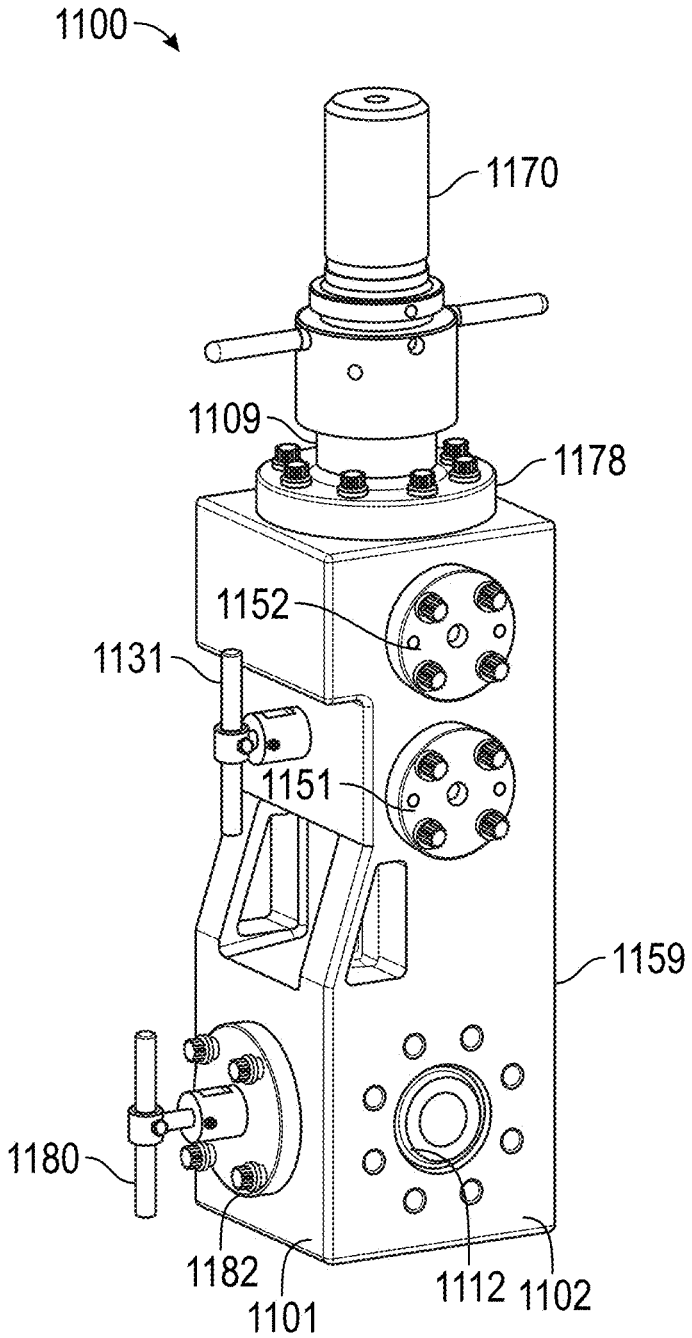
FIG. 13A is a perspective view of another embodiment of a unitary wellhead flow block lubricator assembly that includes two interim distribution blocks.
Figure 13C:
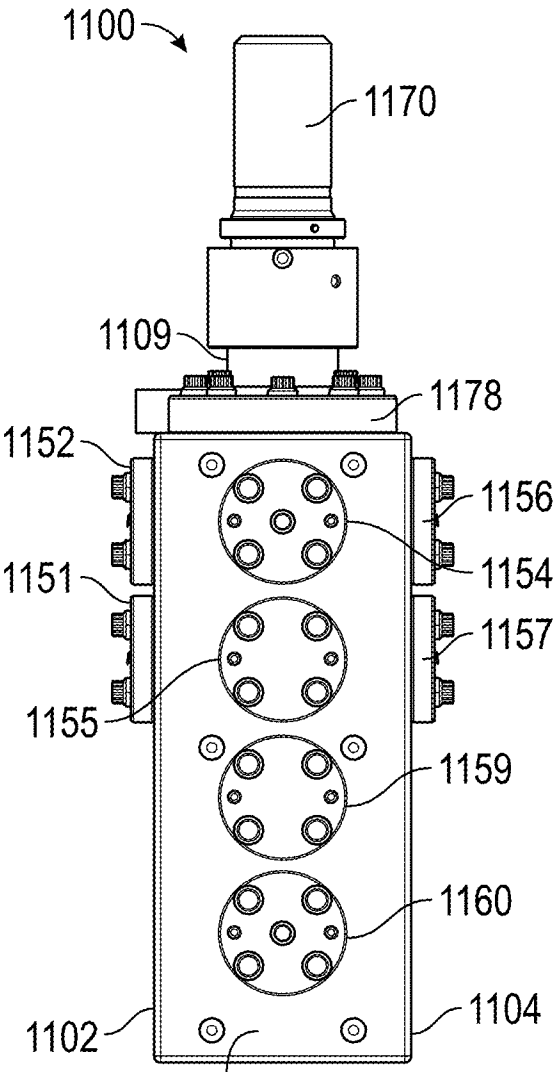
FIG. 13C is a rear view of the wellhead flow block lubricator illustrated in FIG. 13A.
Figure 13B:
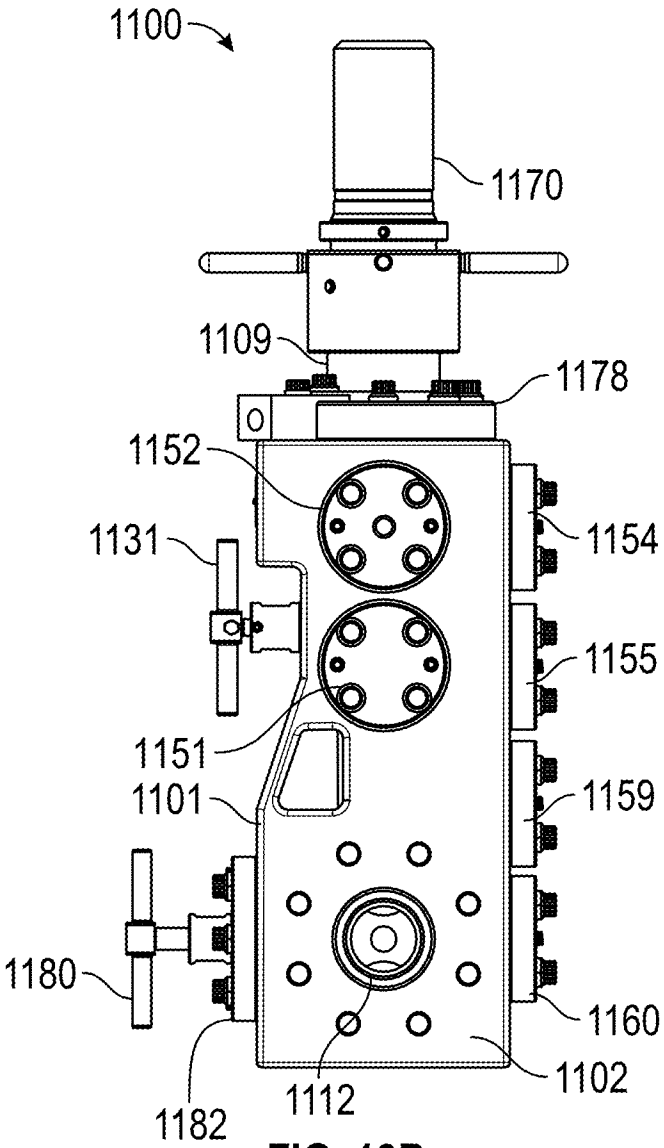
FIG. 13B is a right side view of the wellhead flow block lubricator illustrated in FIG. 13A.
Figure 13E:
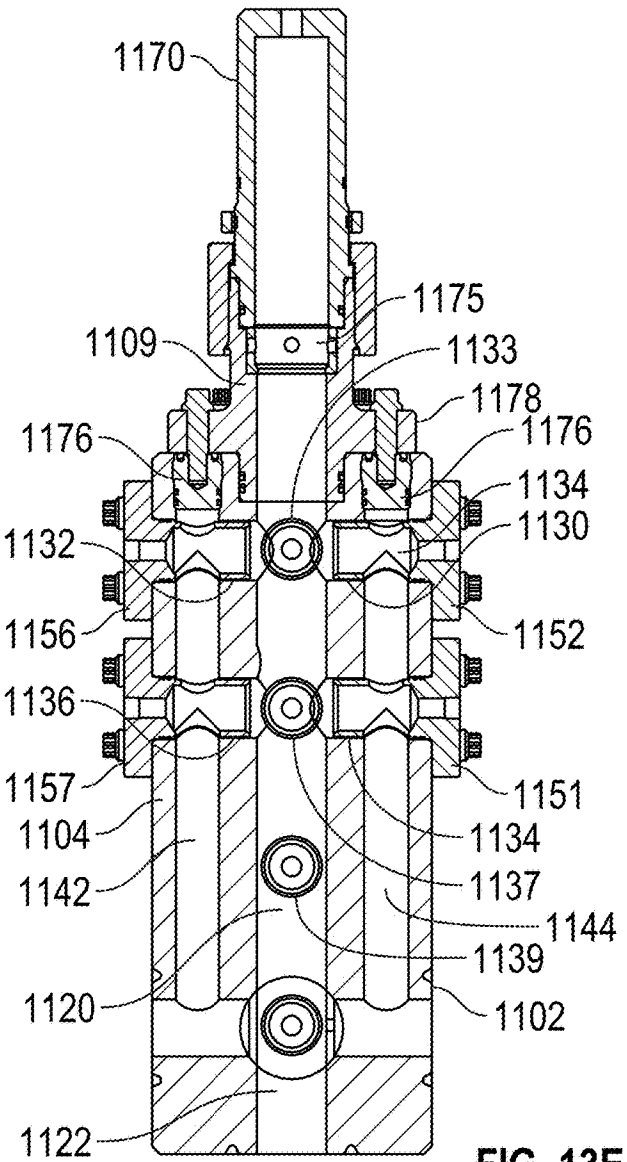
FIG. 13E is a second cross-sectional view of the wellhead flow block lubricator illustrated in FIG. 13A.
Figure 13D:
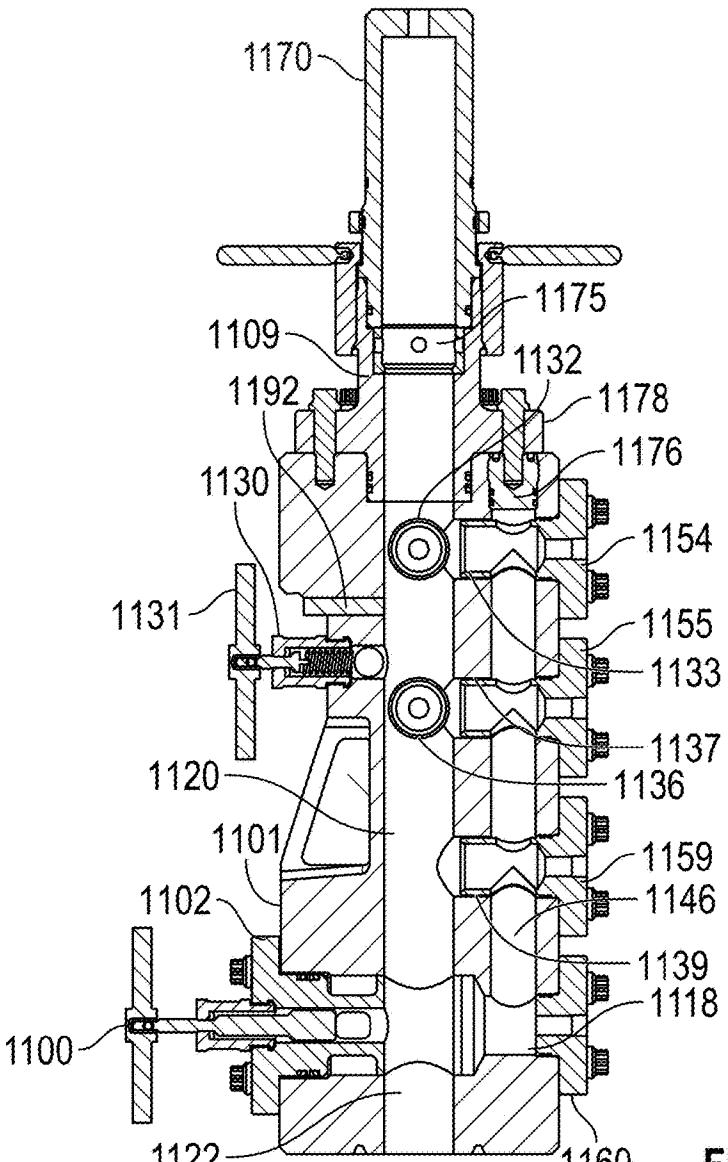
FIG. 13D is a first cross-sectional view of the wellhead flow block lubricator illustrated in FIG. 13A.

As depicted in FIGS. 13D and 13E, the upper distribution block includes a first upper passageway 1130 which leads from the main passageway 1120 to an opening on the first side 1102 of the body. The upper distribution block also includes a second upper passageway 1132 that leads to an opening on an upper portion of the second side 1104 of the body and a third upper passageway 1133 which leads to an opening on the upper portion of the rear side 1105 of the body. A first upper flow control insert 1152 is mounted in the first upper passageway 1130. A second upper flow control insert 1156 is mounted in the second upper passageway 1132. A third upper flow control insert 1154 is mounted in the third upper passageway 1133.

The first interim distribution block includes a first interim passageway 1134 which leads to an opening on an interim portion of the first side 1102 of the body. The first interim distribution block also includes a second interim passageway 1136 which leads to an opening on an interim portion of the second side 1104 of the body and a third interim passageway 1137 which leads to an opening on an interim portion of the rear side 1105 of the body. A first interim flow control insert 1151 is mounted in the first interim passageway 1134. A second interim flow control device 1157 is mounted in the second interim passageway 1136 and a third interim flow control device 1155 is mounted in the third interim passageway 1137

The second interim distribution block in this embodiment includes a fourth interim passageway 1139 which extends from the main passageway 1120 to an opening on a lower interim portion of the rear side 1105 of the body. A fourth interim flow control device 1159 is mounted in the fourth interim passageway 1139.

By providing the second interim distribution block with the fourth interim passageway 1139, one can achieve greater control over the movements of a plunger within the lubricator. For example, in a situation where there is still great pressure driving the fluid and gas up the wellbore, the addition of the fourth interim passageway 1139 makes it possible to bleed off more of the pressure driving the plunger as it is arriving at the top of the lubricator. This can further reduce the speed and momentum of the plunger before it arrives at the top of the lubricator and strikes the anvil 1175. Moreover, the addition of the fourth interim passageway 1139 can help to increase the overall flow through the flow block and out one or both of the outflow passageways 1112, 1114.

FIGS. 14A-14F illustrate yet another alternate embodiment of a flow block lubricator. However, prior to discussing this additional embodiment, we will first discuss the flow control inserts depicted in FIGS. 15A-15C.

Figure 15A:
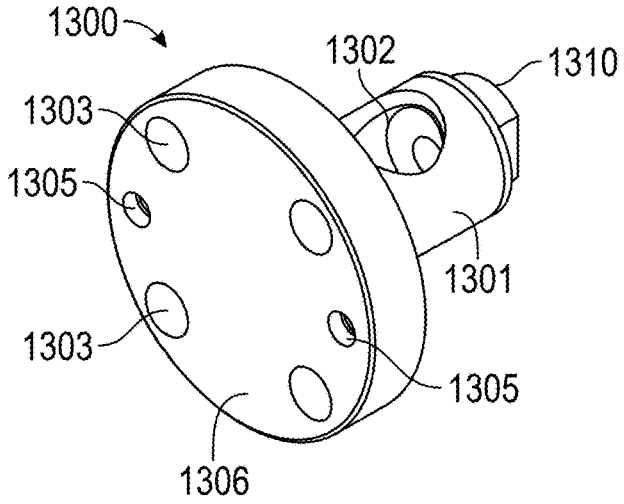
FIGS. 15A-15C illustrate a flow control insert that can be used on a wellhead flow block lubricator.
Figure 15B:
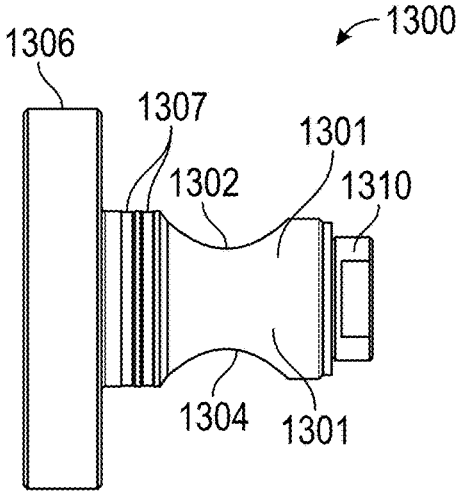
Figure 15C:
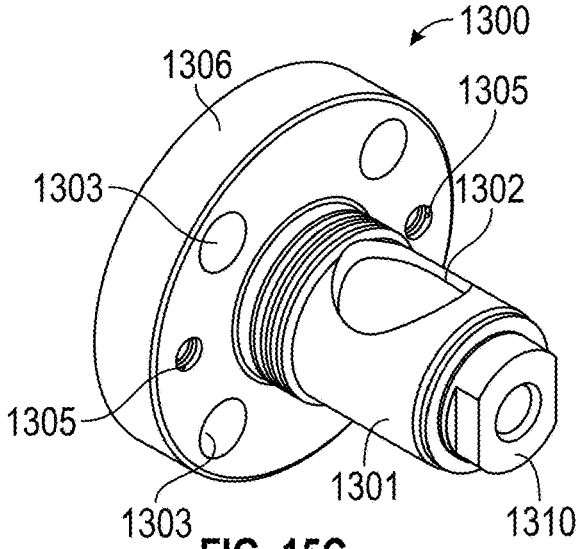

The flow control insert depicted in FIGS. 15A-15C includes a flange 1306 and a cylindrical wall 1301 that extends away from the flange 1306. A plurality of bolt holes 1303 are provided on the flange and are used to attach the flow control insert 1300 over an opening on the exterior of a flow block lubricator. Two or more threaded extraction holes 1305 are also provided in the flange 1306. If one is attempting to remove a flow control insert 1300 that is mounted on a flow block lubricator, and it is difficult to remove the flow control insert 1300, the same bolts that are used to attach the flow control insert 1300 to the exterior of a flow block lubricator can the threaded into the extraction holes 1305 and turned to force the flow control insert back away from the flow block lubricator so that it can be dismounted or removed.

Once the flow control insert 1300 is mounted over an opening on an exterior of a flow block lubricator, the cylindrical wall 1301 of the flow control insert 1300 will extend into one of the passageways extending from the upper or interim distribution blocks of a flow block lubricator. As illustrated in FIGS. 15A-15C, a plurality of apertures 1302, 1304 can be formed in the cylindrical wall 1301. The apertures 1302, 1304 could have a variety of different opening sizes to provide a variety of different flow restrictions.

For example, if a flow control insert 1300 as depicted in FIGS. 15A-15C is mounted in a first rotational orientation over one of the upper openings of the flow block lubricator that open onto the upper passageways of the upper distribution block, the first aperture 1302 would be aligned with a return passageway. If the flow control insert is mounted in a second rotational orientation that is 180° from the first rotational orientation, the second aperture 1304 would be aligned with the return flow passageway. Thus, the rotation orientation in which the flow control insert is mounted over one of the upper openings determines the degree of restriction the flow control insert 1300 imposes on the flow of gas and fluid flowing from the upper distribution block into the return flow passageway.

Figure 16A:
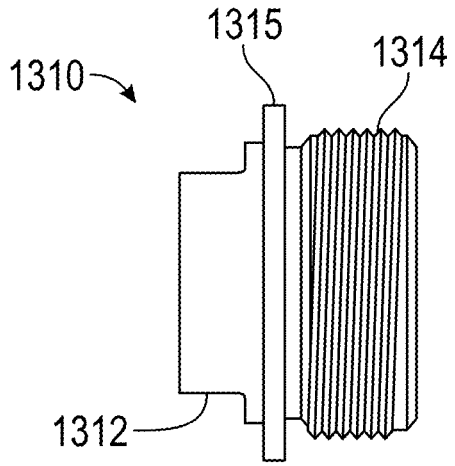
FIG. 16A is a side view of a flow control plug that can be installed on a flow control insert as depicted in FIGS. 15A-15C.
Figure 16B:
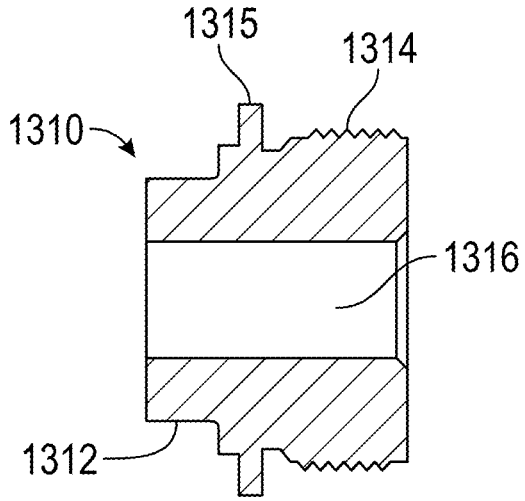
FIGS. 16B-16D are cross-sectional views of three embodiments of a flow control plug as depicted in FIG. 16A.
Figure 16C:
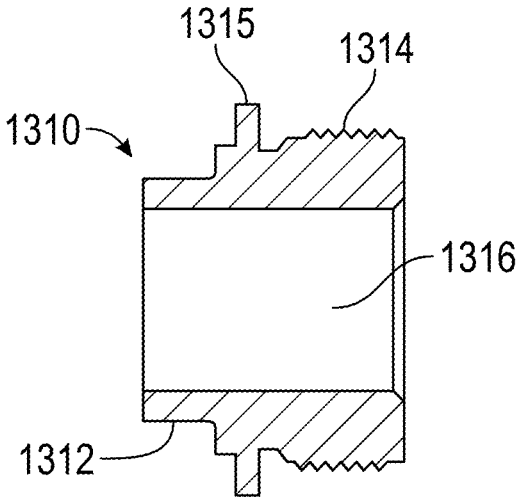
Figure 16D:
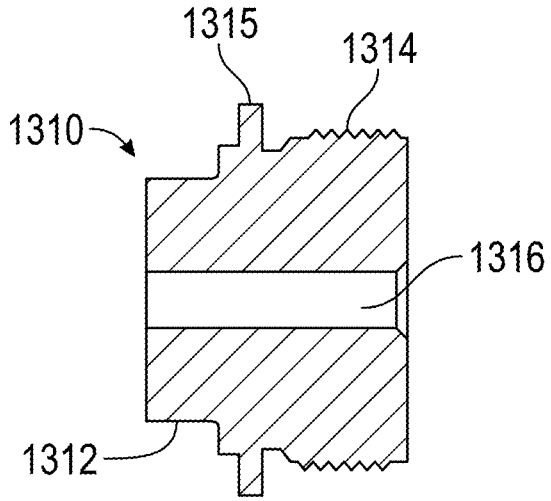

However, the flow control insert 1300 illustrated in FIGS. 15A-15C may also include a flow restriction plug 1310, as illustrated in FIGS. 16A-16D. The flow restriction plug 1310 includes a cylindrical main body 1312 having a central cylindrical aperture 1316 passing there through. Exterior threads 1314 are provided on a first end of the main body 1311. A squared off tool engaging section 1312 is provided on the second end of the main body 1311. The flat edges of the tool engaging portion 1312 can be turned with a wrench to screw the flow restriction plug 1310 into the distal end 1303 of a flow control insert 1300. As depicted in FIGS. 16B-16D, a plurality of different flow restriction plugs 1310 can have a variety of different sized internal passageways 1316 in order to provide varying levels of flow restriction.

When a flow control insert 1300 includes a flow restriction plug 1310, and the flow control insert 1300 is mounted over an opening on the flow block lubricator, gas or fluid flowing out of one of the passageways of the upper or interim distribution blocks must flow through the central aperture 1316 of the flow restriction plug 1310 in order to pass through the flow control insert 1300 and into a return flow passageway of the flow block lubricator. As a result, the size of the interior passageway 1316 of the flow restriction plug 1310 determines a degree of restriction on the flow into the return passageway.

In order to provide a flow control insert 1300 with the minimum degree of flow restriction, one would mount the flow control insert 1300 over an opening on the body of the flow block lubricator without a flow restriction plug 1310 installed. If one wishes to further restrict the flow of fluid and gas into a return flow passageway, one can mount a flow restriction plug 1310 in the distal end 1303 of the cylindrical wall 1301 of a flow control insert 1300 to provide a selected degree of flow restriction.

Returning now to a description of the alternate embodiment of a flow block lubricator as illustrated in FIGS. 14A-14F, this embodiment includes an upper distribution block, a first interim distribution block, and a second interim distribution block. In this embodiment, the second interim distribution block includes interim passageways which extend from the main passageway 1220 to first, second and third return flow passageways 1242, 1244, 1246.

Figure 14A:
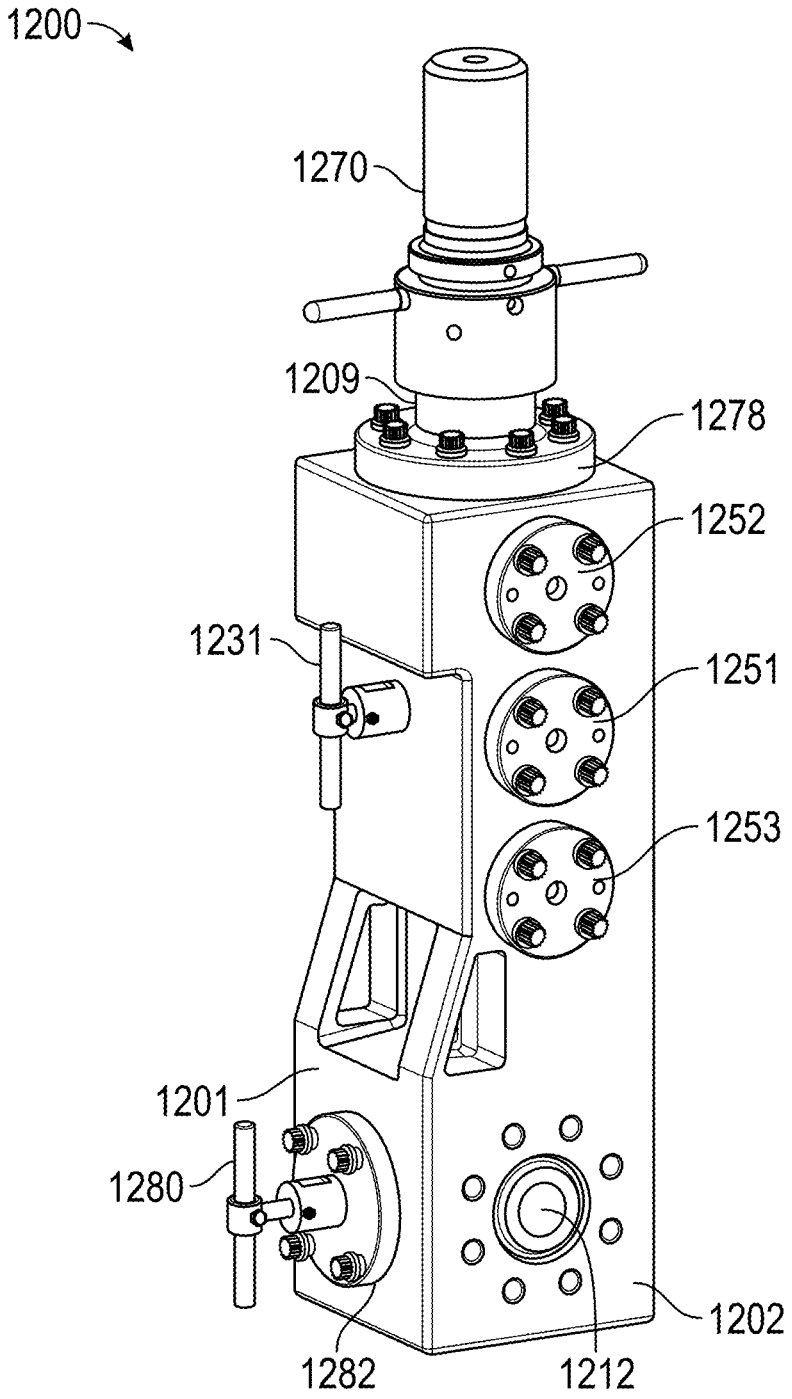
FIG. 14A is a perspective view of another embodiment of a unitary wellhead flow block lubricator assembly that includes two interim distribution blocks.
Figure 14C:
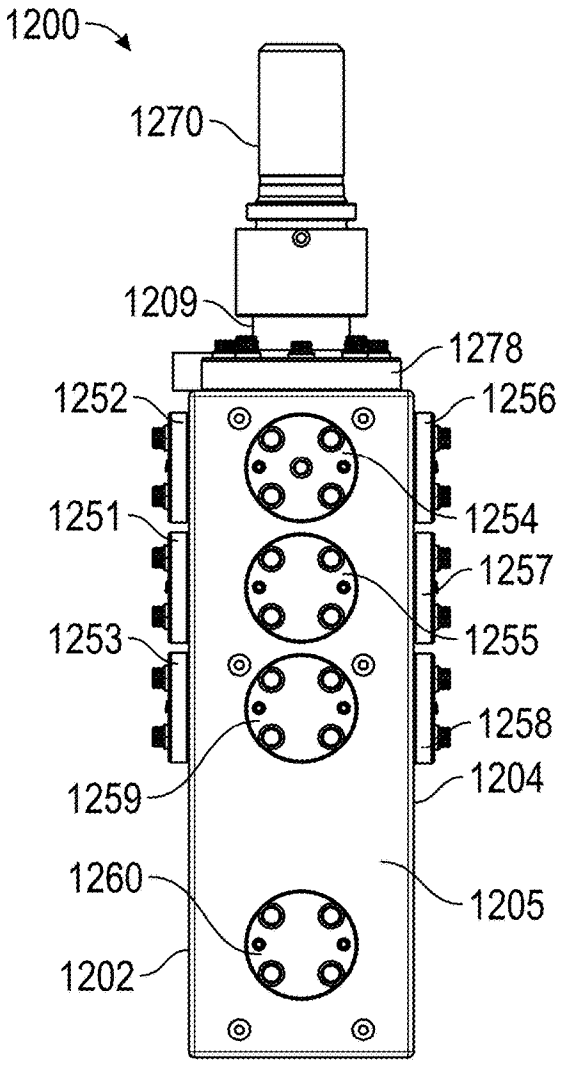
FIG. 14C is a rear view of the wellhead flow block lubricator illustrated in FIG. 14A.
Figure 14B:
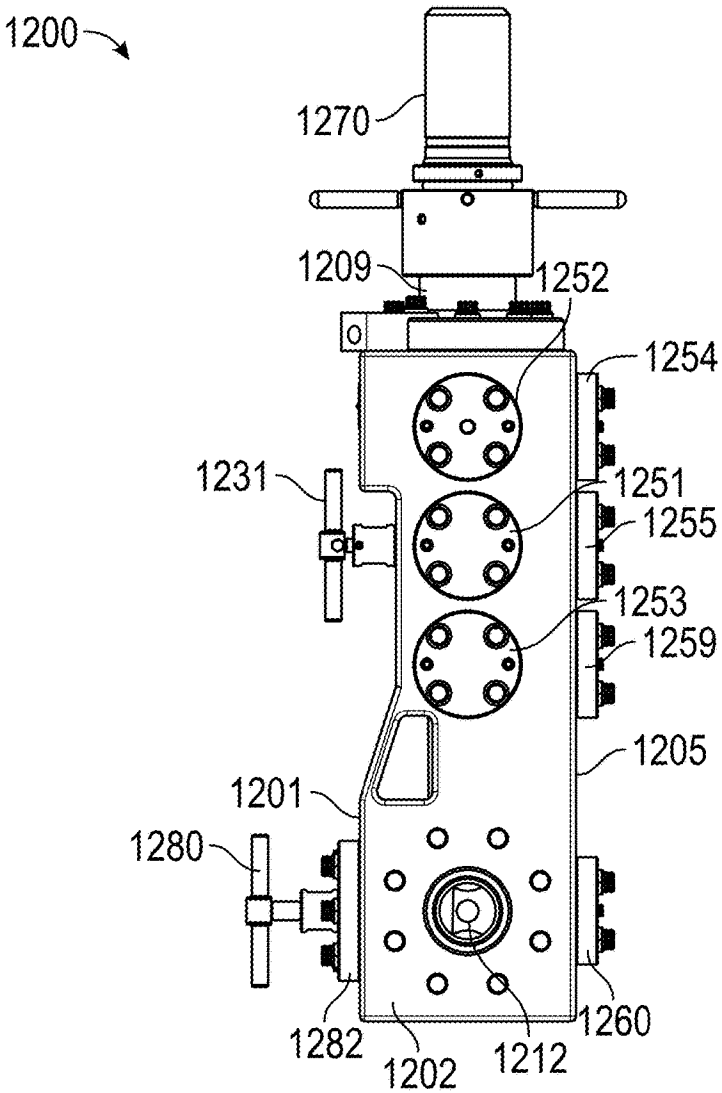
FIG. 14B is a right side view of the wellhead flow block lubricator illustrated in FIG. 14A.
Figure 14D:
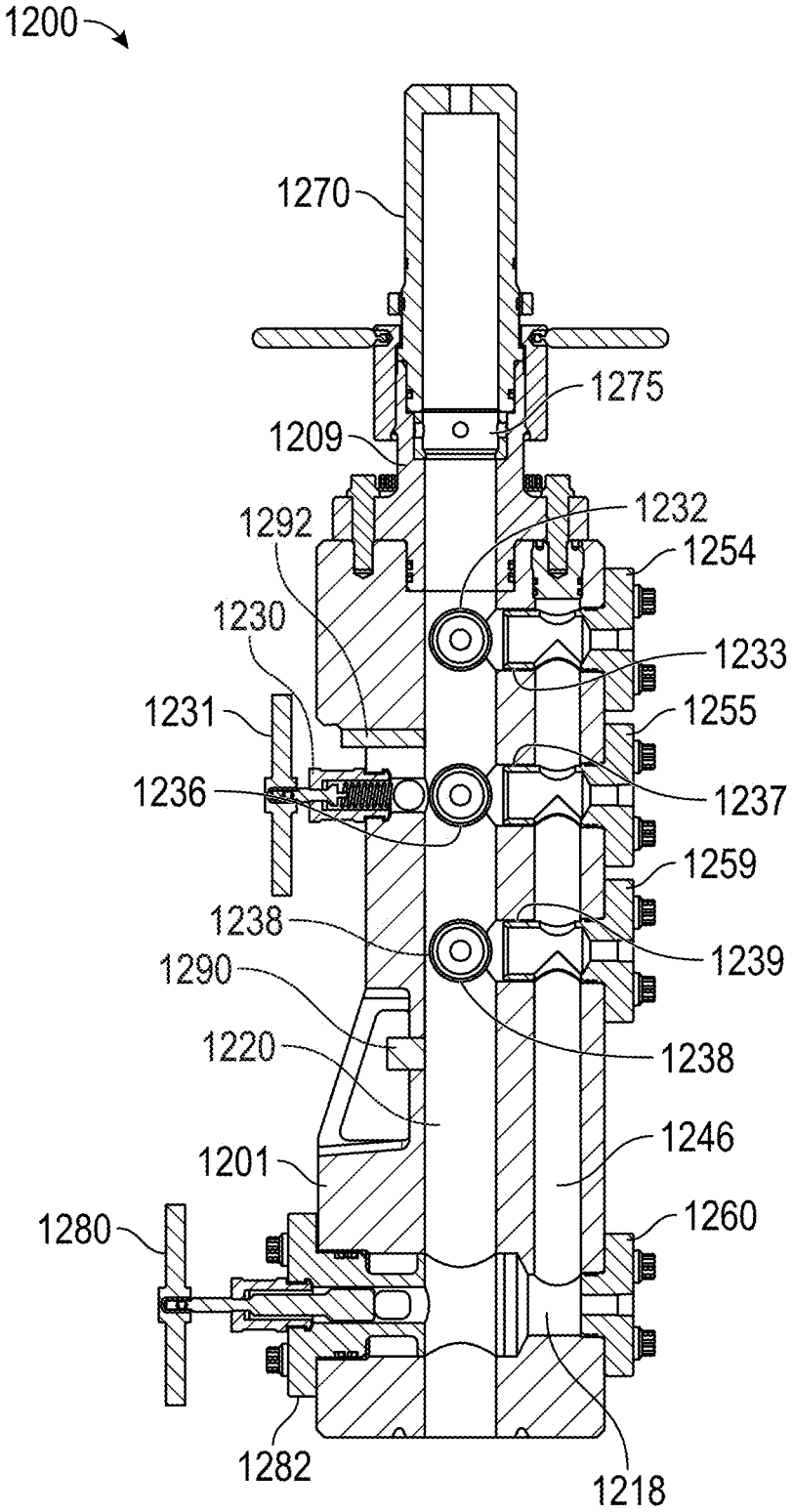
FIG. 14D is a first cross-sectional view of the wellhead flow block lubricator illustrated in FIG. 14A.
Figure 14E:
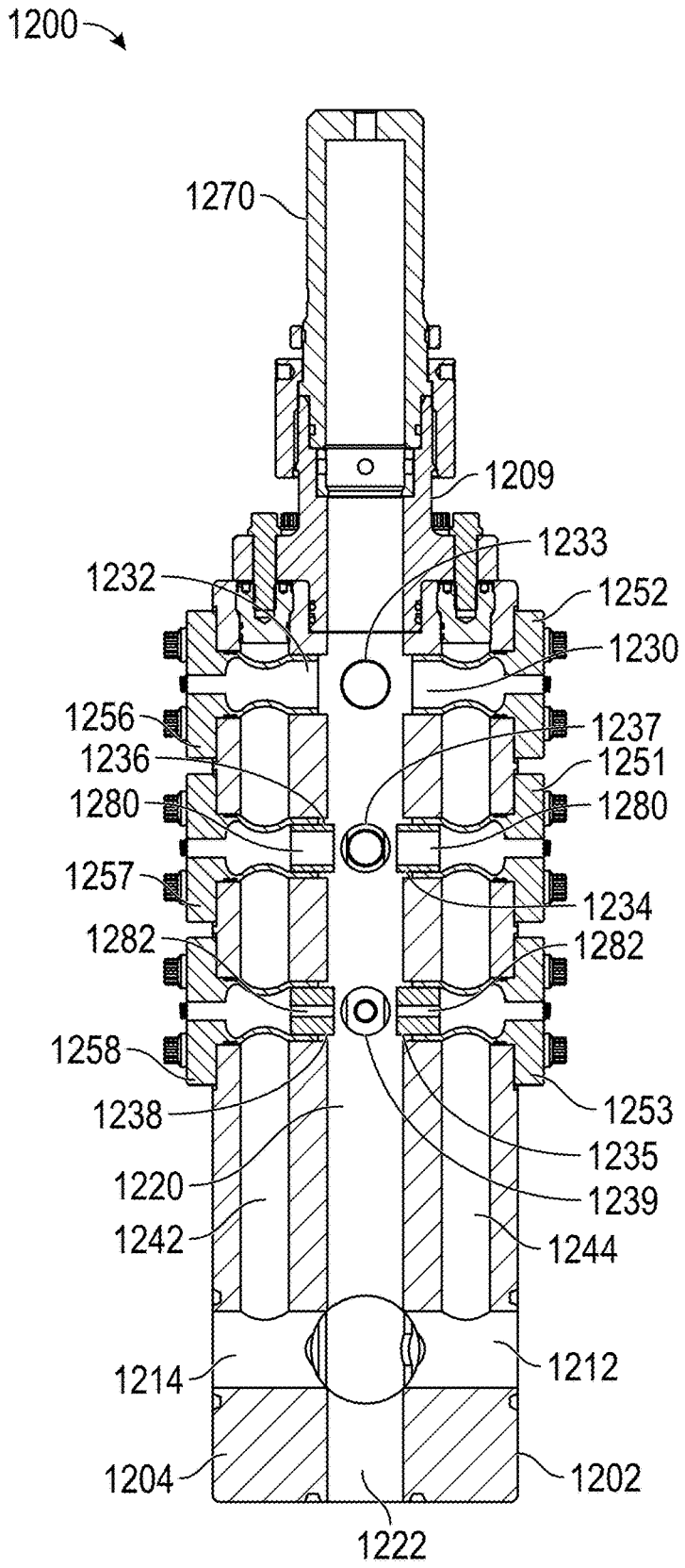
FIG. 14E is a second cross-sectional view of the wellhead flow block lubricator illustrated in FIG. 14A with a first arrangement of flow controls.
Figure 14F:
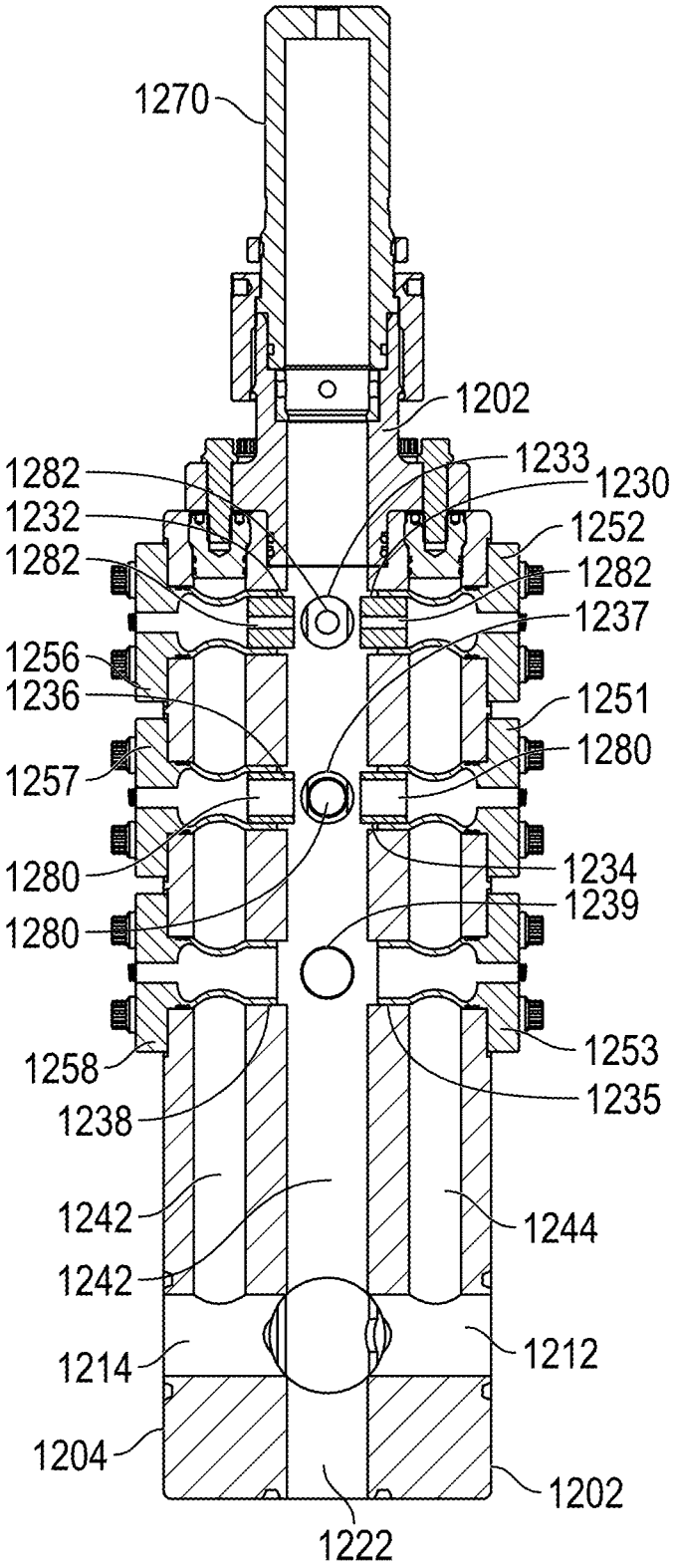
FIG. 14F is a second cross-sectional view of the wellhead flow block lubricator illustrated in FIG. 14A with a second arrangement of flow controls.

FIGS. 14E-14F are basically identical with respect to the structure of the body of the flow block lubricator. However, FIGS. 14E-14F illustrate how different flow control inserts can be configured to provide different types of flow control, as will be explained below.

As illustrated in FIGS. 14D-14E, the upper distribution block of this embodiment includes a first upper passageway 1230 which receives a first upper control insert 1252 mounted over an opening on the upper portion of the first side 1202 of the body. A second upper passageway 1232 receives a second upper flow control insert 1256 mounted over an upper opening on the second side 1204 of the body. A third upper passageway 1233 receives a third upper flow control insert 1254 that is mounted over a third upper opening on the rear side 1205 of the body.

A first interim distribution block includes a first interim passageway 1234 which receives a first interim flow control insert 1251 mounted on a first side 1202 of the body. A second interim passageway 1236 receives a second interim flow control insert 1257 mounted on the second side 1204 of the body. A third interim passageway 1237 receives a third interim flow control insert 1255 mounted on the rear side 1205 of the body.

A second interim distribution block includes a fourth interim passageway 1235 which receives a fourth interim flow control insert 1253 mounted on the first side 1202 of the body. A fifth interim passageway 1238 receives a fifth interim flow control device 1258 mounted on the second side 1204 of the body. A sixth interim passageway 1239 receives a sixth interim flow control insert 1259 mounted on the rear side 1205 of the body.

By providing a second interim distribution block with three passageways 1235, 1238, 1239 extending from the main passageway 1220 to the first, second and third return flow passageways, 1244, 1242, 1246, this embodiment provides even greater control over the movements of a plunger. In addition, this embodiment can provide for freer flowing of fluid through the interior passageways of the flow block lubricator.

FIG. 14E illustrates an embodiment in which the first, second and third upper flow control inserts 1252, 1256, 1254 are like the one illustrated in FIG. 9A of the application, or like the one illustrated in FIGS. 15A-15C but without a flow restriction plug 1310. As a result, the upper flow control inserts 1252, 1256, 1254 provide minimal restriction on the flow of fluid from the main passageway 1220 to the first, second and third return flow passageways 1244, 1242, 1246.

The first interim distribution block with the associated first, second and third interim flow control inserts 1251, 1257 and 1255 have flow control inserts 1300 like the one illustrated in FIGS. 15A-15C. These interim flow control inserts 1251, 1257 and 1255 have flow restriction plugs 1280 which provide a moderate degree of flow restriction into the first, second and third return passageways 1244, 1242, 1246. Thus, flow of fluid from the main passageway 1220 through the first, second and third interim passageways 1234, 1236, 1237 is restricted more than the flow of fluid from the main passageway 1220 through the first, second and third upper passageways 1230, 1232, 1233 of the upper distribution block.

The fourth, fifth and sixth interim flow control inserts 1253, 1258 and 1259 include flow restriction plugs 1282 that have a smaller internal passageway 1316 than the flow restriction plugs 1280 installed in the flow control inserts 1251, 1257, 1255. As a result, flow of fluid from the main passageway 1220 to the first, second and third return flow passageways 1244, 1242, 1246 through the fourth, fifth and sixth interim flow control inserts 1253, 1258 and 1259 is more restricted than flow through the first interim distribution block or the upper distribution block.

One would typically configure a flow block lubricator as illustrated in FIG. 14E in instances where the pressure within the wellbore is not particularly great and it is necessary to restrict the flow through the second interim distribution block and the first interim distribution block in order to ensure that the plunger travels fully up into the top of the flow block lubricator in order to reset the valve within the plunger.

FIG. 14F shows the same basic flow block lubricator as depicted in FIG. 14E, but with the flow control inserts configured differently. In the embodiment illustrated in FIG. 14F, flow restriction plugs 1282 with a narrow internal passageway 1316 are inserted into the first, second and third upper flow control inserts 1252, 1256 and 1254 to provide the greatest amount of flow restriction in the upper distribution block. The first, second and third interim flow control inserts 1251, 1257 and 1255 still include flow restrictor plugs 1280 with a moderate degree of flow restriction. The fourth, fifth and sixth flow control inserts 1253, 1258, 1259 provided at the lower interim distribution block have no flow restriction plugs to provide as little restriction as possible through the second interim distribution block. One would typically configure the flow block lubricator as illustrated in FIG. 14F if the pressure within the wellbore is particularly high, as this would allow pressure to be bled off the main passageway 1220 via the two interim distribution blocks as the plunger travels upward within the lubricator to reduce the amount of pressure driving the plunger upward into the replaceable insert at the top of the lubricator.

The use of flow restriction plugs 1310 to provide varying degrees of flow restriction through a flow control insert is helpful when a flow block lubricator includes both an upper distribution block and one or more interim distribution blocks. Using the embodiment illustrated in FIG. 14D as an example, one can see that fluid flowing from the main passageway 1220 into the upper passageway 1133 of the upper distribution block can flow into the third return passageway 1146 via the third upper flow control insert 1154. Fluid flowing out of the third upper flow control insert 1154 and down the third return passageway 1246 needs to flow across the third interim flow control insert 1255 and the sixth flow control insert 1259 before it reaches the lower distribution block and exits via one or both of the outflow passageways 1212, 1214. To ensure that fluid can flow freely across the third interim flow control insert 1255 and the sixth interim flow control insert 1259, it is desirable to configure the upper opening 1302 and lower opening 1304 of those flow control inserts 1255, 1259 to be as large as possible. Doing that, however, means that one cannot effectively control the flow of fluid from the third interim passageway 1237 and the sixth interim passageway 1239 into the third return flow passageway 1246 using the sizes of the apertures on the cylindrical walls 1301 of the flow control inserts 1255, 1259. The use of flow restriction plugs 1310 mounted in the end of the flow control inserts 1255, 1259, however, makes it possible to apply a selected degree of flow restriction through the flow control inserts 1255, 1259 without impeding the flow of fluid and gas through the third return passageway 1246.

As explained above, a flow control insert which extends into a passageway of one of one of the upper or interim distribution blocks can include different sized apertures 1302, 1304 on the cylindrical wall 1301 to vary the amount of flow restriction that the flow control inserts provide. Thus, the size of the openings 1302, 1304 can alone be used to selectively vary the amount of restriction a flow control insert provides. The addition of the flow restriction plugs 1310 provides an additional way of selectively varying the amount of flow restriction that a flow control insert provides. Both of these features provide a great degree of flexibility in how the flow restriction in various passageways of the flow block lubricator is achieved.

Figure 17A:
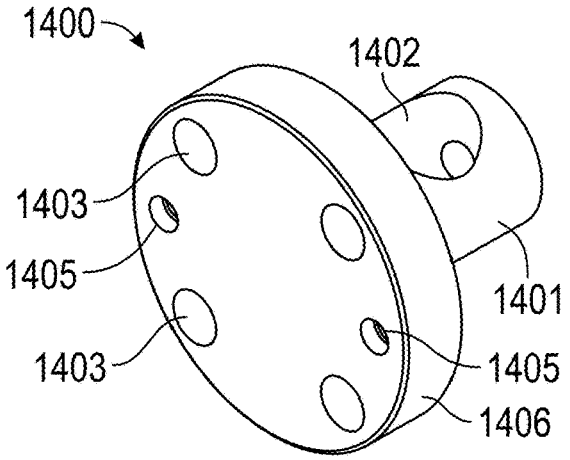
FIG. 17A is a perspective view of another embodiment of a flow control insert that can be installed on a wellhead flow block lubricator.
Figure 17B:
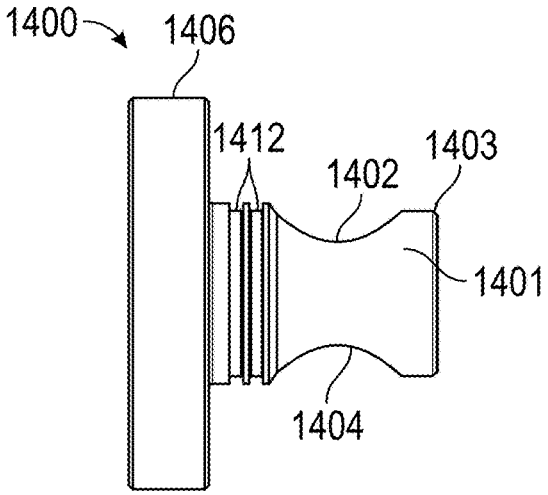
FIG. 17B is a side view of the flow control insert depicted in FIG. 17A.
Figure 17C:
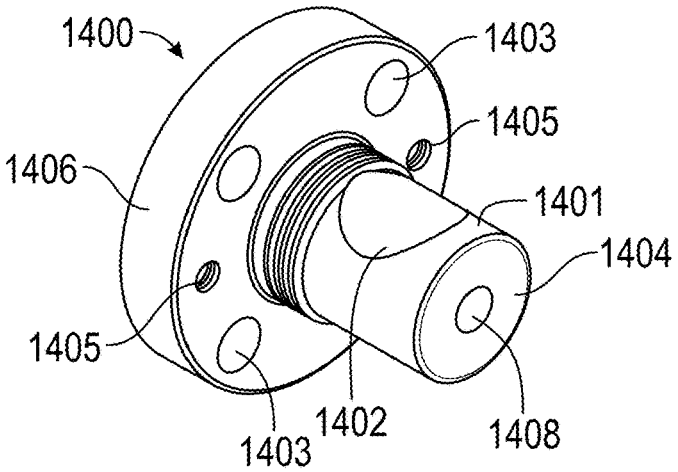
FIGS. 17C-17E are perspective views of three embodiments of a flow control insert like the one depicted in FIG. 17A.
Figure 17D:
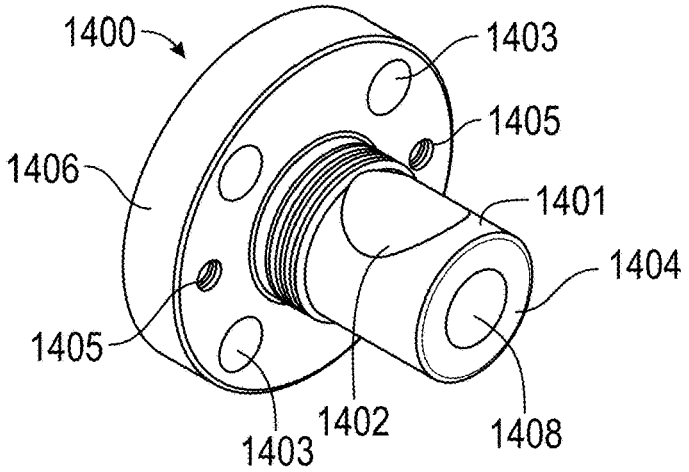
Figure 17E:
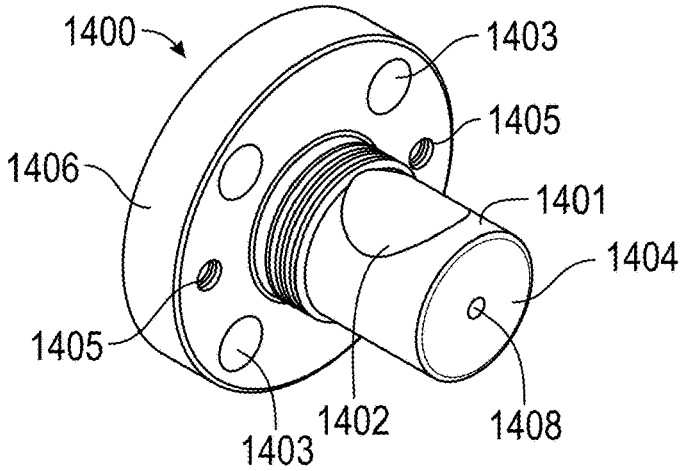

FIGS. 17A-17C illustrate an alternate embodiment of a flow control insert 1400 that is similar to the one illustrated in FIGS. 15A-15C. The flow control insert still includes a flange 1406 having bolt holes 1403 and threaded bolt extraction holes 1405. Apertures 1402 and 1404 are formed on the cylindrical wall 1401. However, in this embodiment the distal end of the cylindrical wall 1401 does not include threads designed to receive a flow restriction plug 1310. Instead, the end of the cylindrical wall 1401 is closed off by a circular end wall 1404 having a central aperture 1408. Different embodiments of a flow control insert 1400, as depicted in FIGS. 17C-17E can be produced with different sized central apertures 1408 in the end wall 1404. Thus, one could select a flow control insert 1400 with an appropriately sized central aperture 1408 to provide a desired degree of flow restriction. While FIGS. 17A-17E depict embodiments where the apertures 1402, 1404 in the cylindrical wall 1401 are all the same large size, in alternate embodiments these aperture 1402, 1404 in the cylindrical wall 1401 could also vary in size to provide varying levels of flow restriction.

Figure 18:
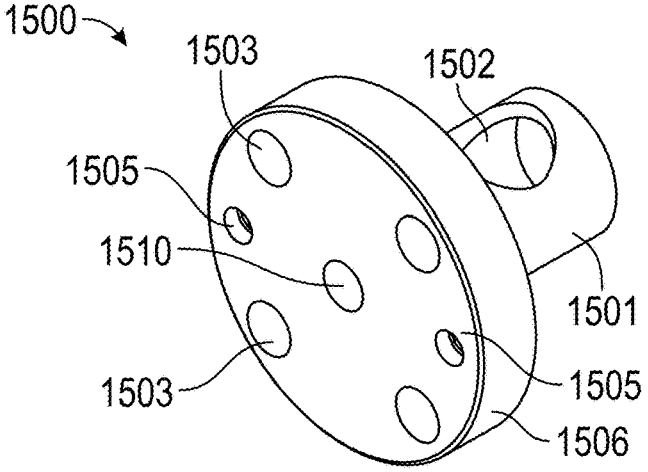
FIG. 18 is a perspective view of another embodiment of a flow control insert that includes an instrumentation aperture.

FIG. 18 depicts yet another embodiment of a flow control insert 1500. This embodiment is similar to the ones depicted in FIGS. 15A-15C or in FIGS. 17A-17C. The flow control insert 1500 includes a flange 1506 having bolt holes 1503 and threaded bolt extraction holes 1505. A cylindrical wall 1502 having an aperture 1502 extends from the flange 1506. However, this embodiment also includes a threaded sensor aperture 1510 in the flange 1506. The sensor aperture 1510 extends all the way through the flange 1506. A sensing device, such as a pressure sensor, could be mounted in the threaded sensor aperture 1510 so that the end of the pressure sensor is exposed to the conditions inside the cylindrical wall 1501.

Conditional language, such as, "can," "could," "might," or "may," unless specifically stated otherwise, or otherwise understood within the context as used, is generally intended to convey that certain implementations could, but do not necessarily, include certain features and/or elements while other implementations may not. Thus, such conditional language generally is not intended to imply that features and/or elements are in any way required for one or more implementations or that one or more implementations necessarily include these features and/or elements. It is also intended that, unless expressly stated, the features and/or elements presented in certain implementations may be used in combination with other features and/or elements disclosed herein.

The specification and annexed drawings disclose example embodiments of the present disclosure. Detail features shown in the drawings may be enlarged herein to more clearly depict the feature. Thus, several of the drawings are not precisely to scale. Additionally, the examples illustrate various features of the disclosure, but those of ordinary skill in the art will recognize that many further combinations and permutations of the disclosed features are possible. Accordingly, various modifications may be made to the disclosure without departing from the scope or spirit thereof. Further, other embodiments may be apparent from the specification and annexed drawings, and practice of disclosed embodiments as presented herein. Examples disclosed in the specification and the annexed drawings should be considered, in all respects, as illustrative and not limiting. Although specific terms are employed herein, they are used in a generic and descriptive sense only, and not intended to the limit the present disclosure.

What is claimed is:

1. A wellhead flow block lubricator, comprising:

a body configured to be attached to an outflow pipe or a master valve of a wellhead;

a lower distribution block located within a lower portion of the body, the lower distribution block communicating with first, second and third lower openings provided, respectively, on a front, a first side and a second side of a lower portion of the body;

an upper distribution block located within an upper portion of the body;

a first interim distribution block located within the body between the upper distribution block and the lower distribution block;

an inlet passageway extending through the body from a bottom of the body to the lower distribution block;

a main passageway extending through the body from the lower distribution block to the upper distribution block, wherein the inlet passageway and the main passageway are aligned with each other and located within the body such that a plunger traveling through the outflow pipe of the wellhead can travel through the inlet passageway and into the main passageway; and a first return passageway that extends through the body adjacent the first side of the body and that is in fluid communication with the upper distribution block, the first interim distribution block and the lower distribution block.

2. The wellhead flow block lubricator of claim 1, wherein the lower distribution block comprises:

a first outflow passageway that extends through the lower portion of the body from the main passageway to the second lower opening on the first side of the body; and a second outflow passageway that extends through the lower portion of the body from the main passageway to the third lower opening on the second side of the body;

wherein the lower distribution block is configured such that fluid flowing into the lower distribution block from the first return passageway can flow out of the body via either or both of the first and second outflow passageways.

3. The wellhead flow block lubricator of claim 1, wherein the upper distribution block comprises a first upper passageway that extends from the main passageway to the first return passageway and wherein the first interim distribution block comprises a first interim passageway that extends from the main passageway to the first return passageway.

4. The wellhead flow block lubricator of claim 3, further comprising a second return passageway that extends through the body adjacent the second side of the body and that is in fluid communication with the upper distribution block, the first interim distribution block and the lower distribution block.

5. The wellhead flow block lubricator of claim 4, wherein the lower distribution block comprises:

a first outflow passageway that extends through the lower portion of the body from the main passageway to the second lower opening on the first side of the body; and a second outflow passageway that extends through the lower portion of the body from the main passageway to the third lower opening on the second side of the body;

wherein the lower distribution block is configured such that fluid flowing into the lower distribution block from either or both of the first and second return passageways can flow out of the body via either or both of the first and second outflow passageways.

6. The wellhead flow block lubricator of claim 4, wherein the upper distribution block comprises a second upper passageway that extends from the main passageway to the second return passageway and wherein the first interim distribution block comprises a second interim passageway that extends from the main passageway to the second return passageway.

7. The wellhead flow block lubricator of claim 6, further comprising a third return passageway that extends through the body adjacent a rear side of the body and that is in fluid communication with the upper distribution block, the first interim distribution block and the lower distribution block.

8. The wellhead flow block lubricator of claim 7, wherein the lower distribution block comprises:

a first outflow passageway that extends through the lower portion of the body from the main passageway to the second lower opening on the first side of the body; and a second outflow passageway that extends through the lower portion of the body from the main passageway to the third lower opening on the second side of the body;

wherein the lower distribution block is configured such that fluid flowing into the lower distribution block from any or all of the first, second and third return passageways can flow out of the body via either or both of the first and second outflow passageways.

9. The wellhead flow block lubricator of claim 7, wherein the upper distribution block comprises a third upper passageway that extends from the main passageway to the third return passageway and wherein the first interim distribution block comprises a third interim passageway that extends from the main passageway to the third return passageway.

10. The wellhead flow block lubricator of claim 1, further comprising a second interim distribution block located between the first interim distribution block and the lower distribution block, wherein the first return passageway is also in fluid communication with the second interim distribution block.

11. The wellhead flow block lubricator of claim 10, wherein the upper distribution block comprises a first upper passageway that extends from the main passageway to the first return passageway, wherein the first interim distribution block comprises a first interim passageway that extends from the main passageway to the first return passageway, and wherein the second interim distribution block comprises a second interim passageway that extends from the main passageway to the first return passageway.

12. The wellhead flow block lubricator of claim 11, further comprising a second return passageway that extends through the body adjacent the second side of the body and that is in fluid communication with the upper distribution block, the first interim distribution block, the second interim distribution block and the lower distribution block, wherein the upper distribution block further comprises a second upper passageway that extends from the main passageway to the second return passageway, wherein the first interim distribution block further comprises a third interim passageway that extends from the main passageway to the second return passageway and wherein the second interim distribution block further comprises a fourth interim passageway that extends from the main passageway to the second return passageway.

13. The wellhead flow block lubricator of claim 12, further comprising a third return passageway that extends through the body adjacent a rear side of the body and that is in fluid communication with the upper distribution block, the first interim distribution block, the second interim distribution block and the lower distribution block, wherein the upper distribution block further comprises a third upper passageway that extends from the main passageway to the third return passageway, wherein the first interim distribution block further comprises a fifth interim passageway that extends from the main passageway to the third return passageway, and wherein the second distribution block further comprises a sixth interim passageway that extends from the main passageway to the third return passageway.

14. The wellhead flow block lubricator of claim 1, further comprising:

a choke passageway that extends through the body from the lower distribution block to the first lower opening on the front of the lower portion of the body; and a choke mechanism installed at least partially in the choke passageway and configured to selectively adjust a flow of fluid passing through the lower distribution block.

15. The wellhead flow block lubricator of claim 1, further comprising:

a first upper opening provided on an upper portion of the first side of the body, wherein the upper distribution block comprises a first upper passageway that extends from main passageway to the first upper opening, and wherein the first upper passageway is in fluid communication with the first return passageway; and a first upper flow control insert mounted over the first upper opening, wherein the first upper flow control insert extends into the first return passageway and is configured to control a flow from the first upper passageway into the first return passageway.

16. The wellhead flow block lubricator of claim 15, further comprising:

a first interim opening provided on the first side of the body below the first upper opening, wherein the first interim distribution block comprises a first interim passageway that extends from main passageway to the first interim opening, and wherein the first interim passageway is in fluid communication with the first return passageway; and a first interim flow control insert mounted over the first interim opening, wherein the first interim flow control insert extends into the first return passageway and is configured to control a flow from the first interim passageway into the first return passageway.

17. The wellhead flow block lubricator of claim 16, wherein the first upper flow control insert restricts the flow from the first upper passageway into the first return passageway by a first amount, and wherein the first interim flow control insert restricts the flow from the first interim passageway into the return passageway by a second amount that is different from the first amount.

18. The wellhead flow block lubricator of claim 17, wherein the flow from the first upper passageway into the first return passageway passes through a restriction passageway in the first upper flow control insert;

wherein the flow from the first interim passageway into the first return passageway passes through a restriction passageway in the first interim flow control insert; and wherein the restriction passageway of the first upper flow control insert has a different size than the restriction passageway of the first interim flow control insert.

19. The wellhead flow block lubricator of claim 16, further comprising:

a second return passageway that extends through the body adjacent the second side of the body and that is in fluid communication with the upper distribution block, the first interim distribution block and the lower distribution block;

a second upper opening provided on an upper portion of the second side of the body, wherein the upper distribution block further comprises a second upper passageway that extends from main passageway to the second upper opening, and wherein the second upper passageway is in fluid communication with the second return passageway; and a second upper flow control insert mounted over the second upper opening, wherein the second upper flow control insert extends into the second return passageway and is configured to control a flow from the second upper passageway into the second return passageway.

20. The wellhead flow block lubricator of claim 19, further comprising:

a second interim opening provided on the second side of the body below the second upper opening, wherein the first interim distribution block further comprises a second interim passageway that extends from main passageway to the second interim opening, and wherein the second interim passageway is in fluid communication with the second return passageway; and a second interim flow control insert mounted over the second interim opening, wherein the second interim flow control insert extends into the second return passageway and is configured to control a flow from the second interim passageway into the second return passageway.

* * * * *